US011832687B2

(12) United States Patent
Van Hoesen

(10) Patent No.: US 11,832,687 B2
(45) Date of Patent: Dec. 5, 2023

(54) FOOTWEAR INTERCHANGEABLE ORNAMENTATION SYSTEM

(71) Applicant: Flipping Bling, LLC, Myrtle Beach, SC (US)

(72) Inventor: Kay Van Hoesen, Myrtle Beach, SC (US)

(73) Assignee: Flipping Bling, LLC, Myrtle Beach, SC (US)

( * ) Notice: Subject to any disclaimer, the term of this patent is extended or adjusted under 35 U.S.C. 154(b) by 0 days.

(21) Appl. No.: 17/206,309

(22) Filed: Mar. 19, 2021

(65) Prior Publication Data

US 2021/0289887 A1 Sep. 23, 2021

Related U.S. Application Data

(60) Provisional application No. 62/992,339, filed on Mar. 20, 2020.

(51) Int. Cl.

| | |
|---|---|
| ***A43B 23/24*** | (2006.01) |
| *A43B 3/12* | (2006.01) |
| *A43B 3/10* | (2006.01) |

(52) U.S. Cl.

CPC ..... *A43B 23/24* (2013.01); *A43B 3/101* (2013.01); *A43B 3/12* (2013.01)

(58) Field of Classification Search

CPC ..... A43B 3/0078; A43B 23/24; A43B 3/101

See application file for complete search history.

(56) References Cited

U.S. PATENT DOCUMENTS

| | | | | | |
|---|---|---|---|---|---|
| 3,011,281 | A * | 12/1961 | King | A43B 3/0078 | 36/94 |
| 4,879,787 | A * | 11/1989 | Walls | A43B 23/24 | 24/712.2 |
| 5,913,483 | A * | 6/1999 | Polk | A43C 7/02 | 24/712.2 |
| 7,044,508 | B2 * | 5/2006 | Burns | A43C 7/005 | 289/1.5 |

(Continued)

FOREIGN PATENT DOCUMENTS

| | | |
|---|---|---|
| BR | PI0703199 | 5/2009 |
| JP | 2010214138 | 9/2010 |

OTHER PUBLICATIONS

Lindsay Phillips, The Original SwitchFlops, https://lindsay-phillips.com/, Jan. 19, 2018.

(Continued)

*Primary Examiner* — Ted Kavanaugh

(74) *Attorney, Agent, or Firm* — Burr & Forman LLP; Douglas L. Lineberry

(57) ABSTRACT

An interchangeable ornamentation system for a footwear comprises a base fastener affixed to a base. The base and the base fastener collectively define a foundation. A first strap and a second strap are coupled to the base. The first strap and the second strap are both configured to individually couple to foot straps of the footwear for matingly and removable attachment to the base fastener so that the foundation is removably attached to the footwear. A removable ornamentation includes a decorative member and an ornamentation fastener. The decorative member oppositely faces the ornamentation fastener. The ornamentation fastener is configured to matingly and removably attach to the base fastener.

7 Claims, 42 Drawing Sheets

(56) References Cited

U.S. PATENT DOCUMENTS

| | | | | |
|---|---|---|---|---|
| 8,082,683 | B1 * | 12/2011 | Munch | A43B 3/126 36/11.5 |
| 8,914,915 | B1 | 12/2014 | Alari et al. | |
| 9,259,055 | B1 | 2/2016 | Raynor | |
| 2009/0300948 | A1 | 12/2009 | Nordstrom-Wehner | |
| 2010/0011623 | A1 | 1/2010 | Seckler et al. | |
| 2010/0018076 | A1 | 1/2010 | Buck | |
| 2010/0186258 | A1 | 7/2010 | Garza | |
| 2011/0225851 | A1 | 9/2011 | Nelson | |
| 2012/0183168 | A1 | 7/2012 | Humes | |
| 2013/0025165 | A1 | 1/2013 | Hunter et al. | |
| 2013/0273304 | A1 | 10/2013 | Blue | |
| 2014/0352175 | A1 | 12/2014 | Katz | |
| 2018/0317617 | A1 * | 11/2018 | Rendon | A44C 25/00 |

OTHER PUBLICATIONS

Heather Luckhurst, DIY Flower Clips for Flip Flops & Sandals—Setting for Four, https://www.settingforfour.com/diy-tulle-flower-clips-for-flip-flops-sandals/, Jan. 19, 2018.

* cited by examiner

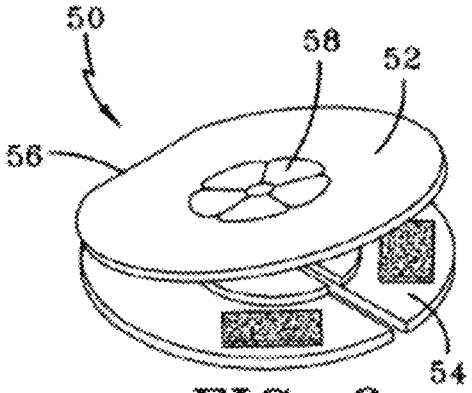
FIG-6
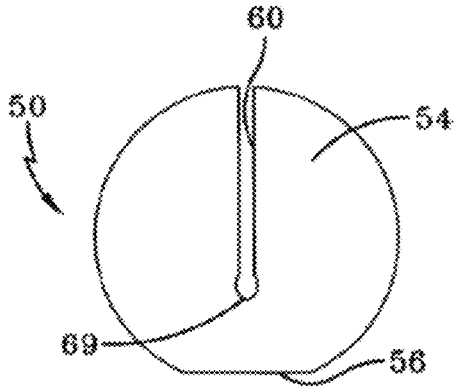
FIG-7
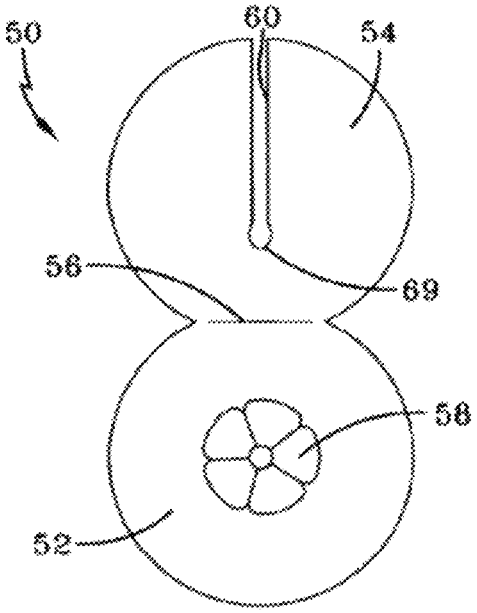
FIG-8
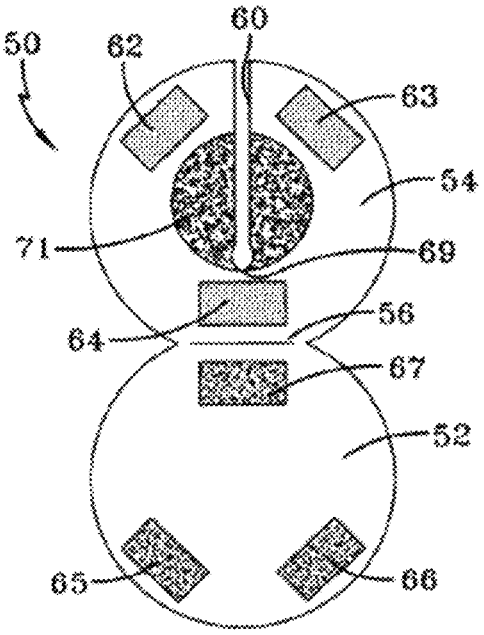
FIG-9
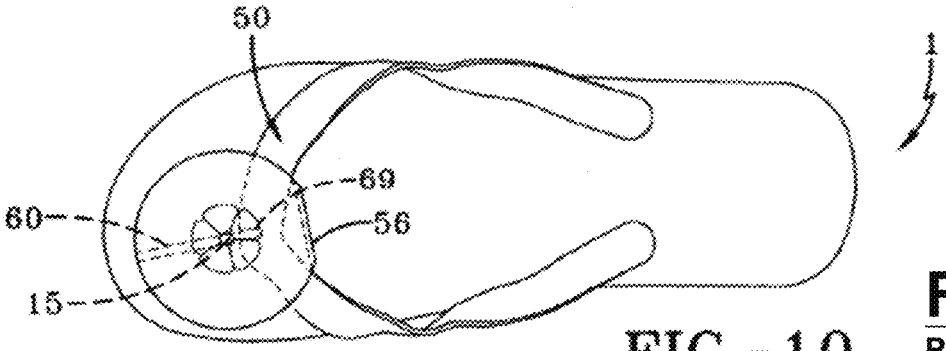
FIG-10
FIG. 8
PRIOR ART

FOOTWEAR INTERCHANGEABLE ORNAMENTATION SYSTEM

TECHNICAL FIELD

The subject matter disclosed herein is generally directed to footwear ornamentation and, more particularly, relates to an interchangeable ornamentation system for footwear, such as flip flops or sandals.

BACKGROUND

Often times, it is difficult to find a single pair of footwear to match a wide variety of different types of outfits. For example, more casual footwear, such as flip flops or sandals, worn during the daytime may not be appropriate for or match an outfit worn during a more formal evening engagement. In efforts to accommodate versatility for a single pair of footwear, some common attempts have been to adorn an existing pair of footwear with loosely attached accessories. Other common efforts include customizing an upscale pair of flip flops or sandals with specialized ornamentation intended for those particular flip flops or sandals such that the specialized ornamentation is not interchangeable with other types of flip flops or sandals.

Various attempts have been made to accessorize women's shoes. For example, PI0703199-8 shows a broach for sandals, see FIG. 1. This system employs a base platform with rubber bands/elastic elements grasping onto the shoe and accessories that engage the platform via male/female engagement.

JP 2010-214138, see FIG. 2, discloses a snap-fit system where an ornament/decoration is affixed to a thong that wraps around the sandal strap and snaps into a fixture on the back side of the ornament/decoration.

U.S. Pat. No. 8,082,683, see FIG. 3, discloses a detachable material wrapped around a strap of a footwear that guards against blister formation, provides comfort and a softer feel against a foot, and to add aesthetic value. In one embodiment, the detachable material is a strip made of self-fastening material. In another plurality of loops. The detachable material is reusable and adjustable. (Abstract)

U.S. Pat. No. 8,914,915, see FIG. 4, shows a decorative footwear adornment providing removable and reusable ornamentation for use upon existing footwear including an attachable base plate embellished with a decorative element or indicia. The base plate includes extending malleable attachment arms, each encased within a flexible polymer material, which are wrapped around and secured to straps or other portions of the footwear. The flexible nature of the attachment arms enables a user to repeatedly interchange and reuse the adornments with various footwear. (Abstract.)

U.S. Pat. No. 9,259,055, see FIG. 5, discloses a footwear accessory device, having a frame assembly with a top face and a bottom face. The top face has first fastening means and the bottom face has a spring member with a spring force. Protruding from the frame assembly are first and second tabs and hinge arms. An actuating arm is hingedly mounted onto the frame assembly. The actuating arm further comprises longitudinal members, at least one transversal member, and locking members. The locking members receive their respective first and second tabs when the first and second tabs are biased towards their respective locking members, thus overcoming the spring force when a shoelace knot is positioned between the spring member and the actuating arm to cover a shoelace to prevent the loosening or untying of the tied shoelace knot. At least one interchangeable assembly has second fastening means that secures onto the first fastening means. (Abstract.)

U.S. Pat. Pub. 2009/0300948, see FIG. 6, discloses an adornment for an article of footwear having a forefoot portion that includes a thong portion adapted to be positioned between a wearer's toes, and a forefoot cover connected to the thong portion. The adornment includes a clip that has a legged structure having a pair of spaced apart legs, or elongate extensions, adapted to straddle a portion of the footwear and a mount supported relative to the elongate extensions. The adornment also includes a decorative accessory disposed on the mount and may be adapted to releasably engage the mount. (Abstract.)

U.S. Pat. Pub. 2010/0011623, see FIG. 7, discloses a flip-flop or other article of apparel includes a fastening member at least a substantial portion of which is embedded into an article of apparel and releasably receives a mating fastening member that is attached to an ornament. (Abstract.)

U.S. Pat. Pub. 2010/0018076, see FIG. 8, shows a stabilizing device for V-strap sandals wherein the device is engageable with the thong and strap for impeding movement between a wearer's foot and the sandal, and connection means for releasably connecting the stabilizing device to a V-strap sandal. (Abstract.)

U.S. Pat. Pub. 2010/0186258, see FIG. 9, discloses the present invention generally relates to a shoe system that has one or more interchangeable members. This invention consists of a shoe, boot or sandal foundation that is constructed with a depression or an allotted space on the foundation that allows for an attachable cover member that may be used to embellish the shoe or to color coordinate with an outfit or accessories. (Abstract.)

U.S. Pat. Pub. 2011/0225851, see FIG. 10, shows an ornamentation attachable to a strap, such as a strap on an item of footwear. The ornamentation comprises a base, an ornament associated with the base and a means for mounting the base to the strap. The ornament may be associated with the base in any appropriate way; for example, by being formed integrally with the base, permanently attached to the base or removably attachable to the base. The base is configured for engagement by the mounting means. The mounting means comprises an elastic band adapted to be hooked onto curved end portions of the base. (Abstract.)

U.S. Pat. Pub. 2012/0183168, see FIG. 11, discloses accessory systems and methods are provided. An accessory may be designed with two loops (such as an elastomeric strap or two elastic loops) attached to the back of a decorative ornament using, for example, an interlocking post. The accessory may be removably attached to footwear. The ornament may rest on the upper part of a shoe, while the two elastic loops secure the ornament by coming together underneath the shoe strap, upper or lace to form a single combined loop and then flipping over the ornament, thereby holding it in place. These accessory ornaments may be moved from shoe to shoe, allowing the wearer to create their own look. In addition, the wearer may change the ornament on the same shoe, changing the look of that one shoe, depending on the chosen ornament. The accessory ornament may be attached to other objects, such as ski poles, helmets, goggles, bike handle bars, zippers, and purses. The accessory ornament may include a media player, speakers and a computer processor to execute the media player and facilitate playback of music. (Abstract.)

U.S. Pat. Pub. 2013/0025165, FIG. 12, discloses a shoe or other type of footwear includes a foot covering through which a threaded connector part passes. An ornament or useable object includes a mating threaded connector, enabling attachment of the object to the footwear. A resilient ring or washer is positioned between the mating threaded connectors, and enables rotation of the object to a desired orientation after a sufficiently secure connection is formed between the object and the footwear. (Abstract.)

U.S. Pat. Pub. 2013/0273304, FIG. 13, discloses a decorative fastener that includes a base fitted with eyes or receptacles on the underside of the base and one or two straps that protrude from the lower portion of the base underside and which are fitted with hooks on their exposed ends. The straps wrap back over themselves, around any particular item of wear, and fasten using the hooks on the straps and the eyes on the underside of the base. The decorative fastener may also include a plurality of interchangeable decorative disc options, or removable strap options, thus allowing the wearer to change decorations easily and inexpensively. (Abstract.)

U.S. Pat. Pub. 2014/0352175, FIG. 14, discloses Zori style fashion shoes which hold a decorative insert. The Zori straps are tubular in nature, with a transparent upper surface. An opening between the right and left straps enables the insertion of a decorative insert. A one piece decorative insert extends into the right strap and the left strap. The wearer of the shoe can remove and replace an insert with another of a different design. A transparent hook like tongue may extend from one strap to another, to protect the insert from soiling. Optionally, the straps may have a springy section of material applied at the end near the arch section of the shoe. (Abstract.)

However, the above disclosures lack a fully versatile and variable shoe ornamentation system capable of adapting to myriad styles of footwear. Further, current systems and designs are localized with respect to attachment options, which necessarily limits placement and positioning of the ornamentation on the footwear. Accordingly, it is a goal of the current disclosure to provide a highly versatile footwear interchangeable ornamentation system that allows for varied placement and attachment options with respect to both the footwear and the system itself such that a user may affix the system at various locations on the footwear at the user's preference.

Citation or identification of any document in this application is not an admission that such a document is available as prior art to the present disclosure.

SUMMARY

The above objectives are accomplished according to the present disclosure by providing in a first embodiment an interchangeable ornamentation affixer substrate. The substrate may include a textured upper surface, a textured lower surface, a middle section located between the textured upper surface and textured lower surface, a textured first affixment arm, a textured second affixment arm, wherein the first affixment arm and the second affixment arm may be attached to the ornamentation affixer substrate at the middle section of the ornamentation affixer substrate, at least the upper surface, lower surface, first affixment arm and second affixment arm may be configured for matingly and removable attachment to one another via textured surfaces. Further, at least one of the textured upper surface or the textured lower surface may comprise a surface adhesive. Still, the textured lower surface may comprise different surface adhesives. Again, a first removable ornamentation may be affixed to the textured upper surface. Moreover, the first removable ornamentation may be removed and replaced with a second removable ornamentation. Still yet, the interchangeable ornamentation affixer substrate may be affixed to footwear. Yet further, the textured first affixment arm and second affixment arm may be pliable with respect to the middle section. Again still, the textured first affixment arm and second affixment arm may be configured to removably attach and detach from one another. Further again, the textured first affixment arm and second affixment arm may be configured to have an upper arm surface and lower arm surface wherein at least one of the upper arm surface and lower arm surface comprise a surface adhesive. Still moreover, the upper arm surface and lower arm surface of the textured first affixment arm and second affixment arm may comprise different surface adhesives from one another.

In another embodiment, a removable ornamentation system is provided. The system may include a decorative member, an ornamentation fastener that includes a textured upper surface, a textured lower surface, a middle section located between the textured upper surface and textured lower surface, at least one affixment arm and at least one affixment arm may be attached to the ornamentation affixer substrate at the middle section of the ornamentation affixer substrate, at least the upper surface, lower surface, and the at least on affixment arm may be configured for matingly and removable attachment to one another via textured surfaces, and the decorative member oppositely faces the ornamentation fastener, with the ornamentation fastener configured to matingly and removably attach to an ornamentation fastener substrate. Further, the at least one of the textured upper surface or the textured lower surface may comprise a surface adhesive. Still, the textured upper surface and the textured lower surface may comprise different surface adhesives. Again, a first removable ornamentation may be affixed to the textured upper surface. Further still, the first removable ornamentation may be removed and replaced with a second removable ornamentation. Again yet, the interchangeable ornamentation affixer substrate may be affixed to footwear. Moreover, the at least one affixment arm is pliable with respect to the middle section. Further again, the at least one affixment arm may be configured to removably attach and detach from itself. Again still, the at least one affixment arm may be configured to have an upper arm surface and a lower arm surface wherein at least one of the upper arm surface and lower arm surface comprise a surface adhesive. Still further, the upper arm surface and lower arm surface of the at least one affixment arm may comprise different surface adhesives from one another.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which:

FIG. 8 shows a prior art ornamentation system;

Figures 1, 2:
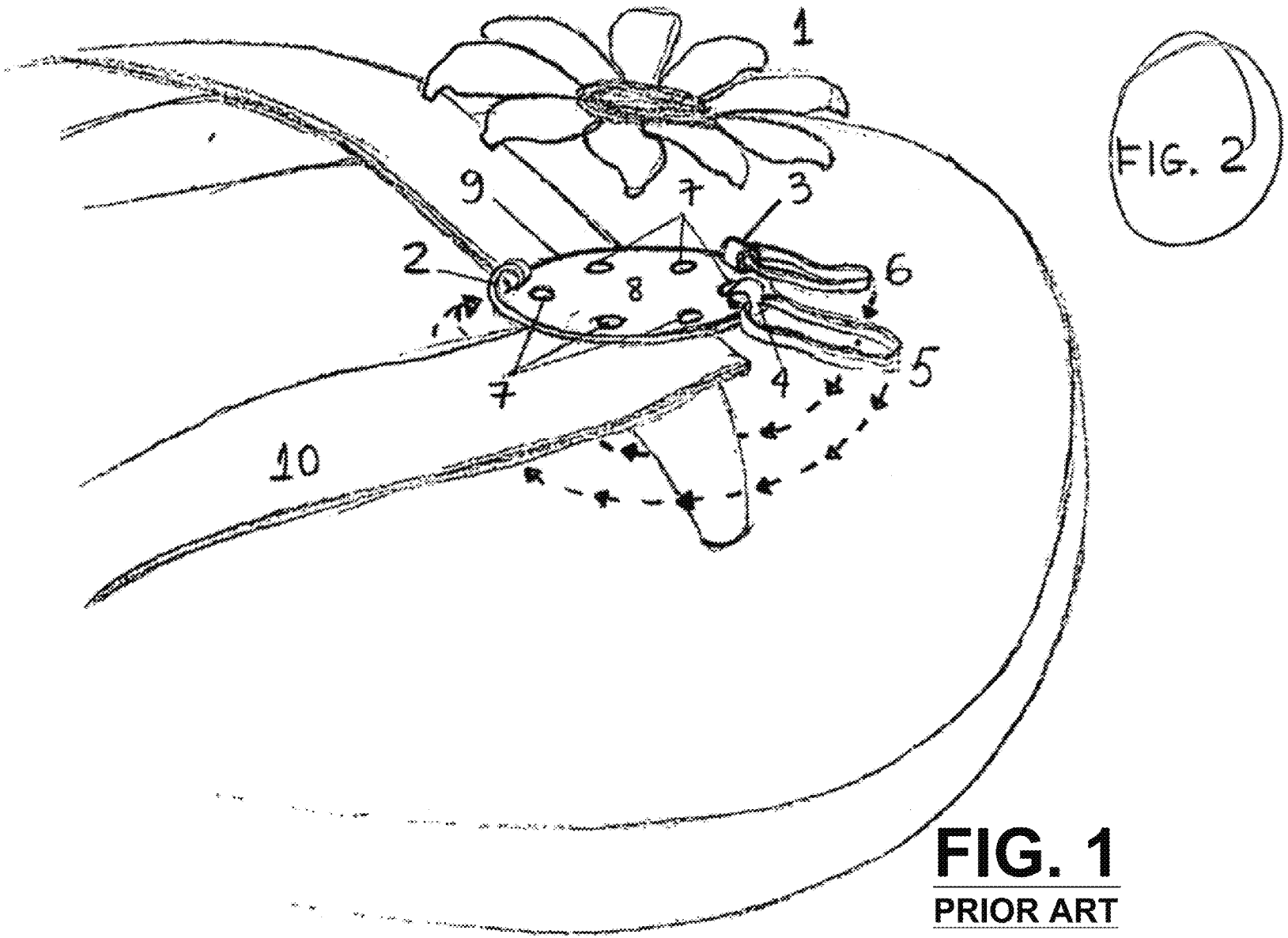
FIG. 1 PRIOR ART
FIG. 1 shows a prior art ornamentation system.
FIG. 2 shows a prior art ornamentation system.
Figure 2:
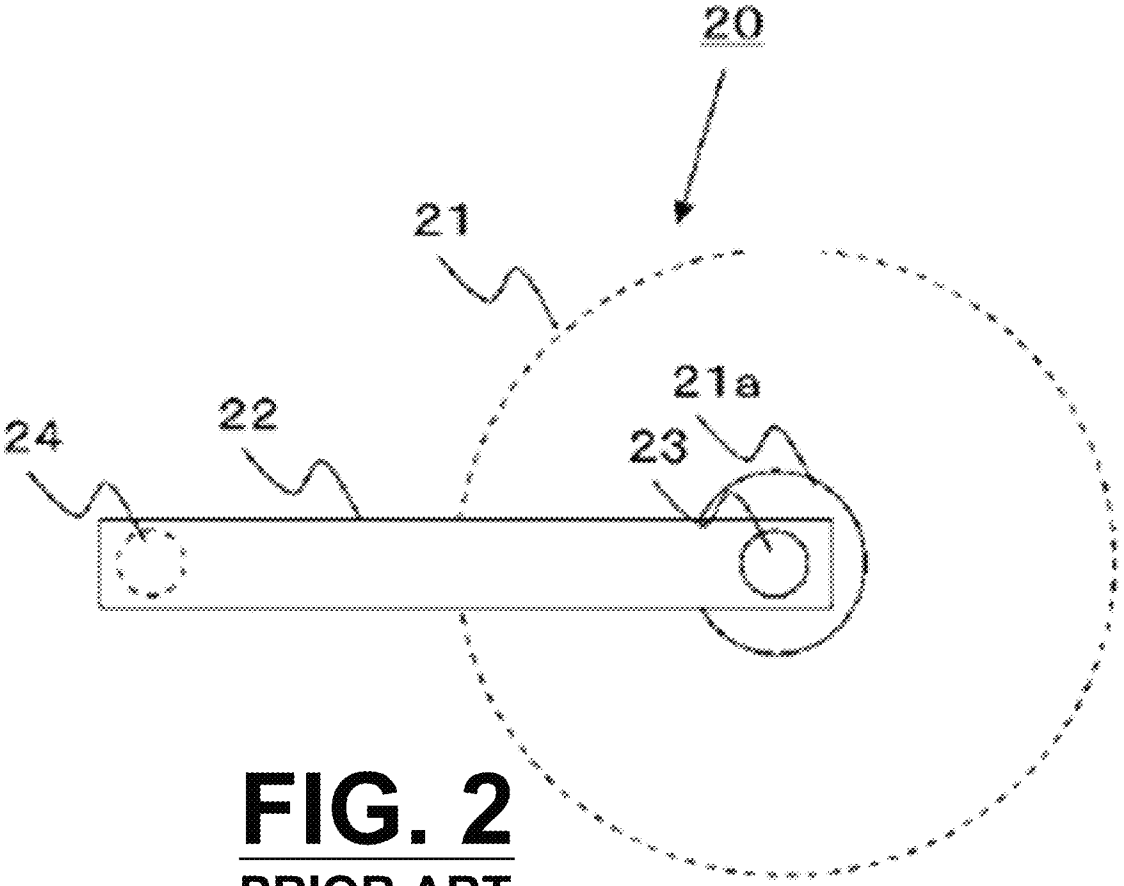
FIG. 2 PRIOR ART
Figure 3:
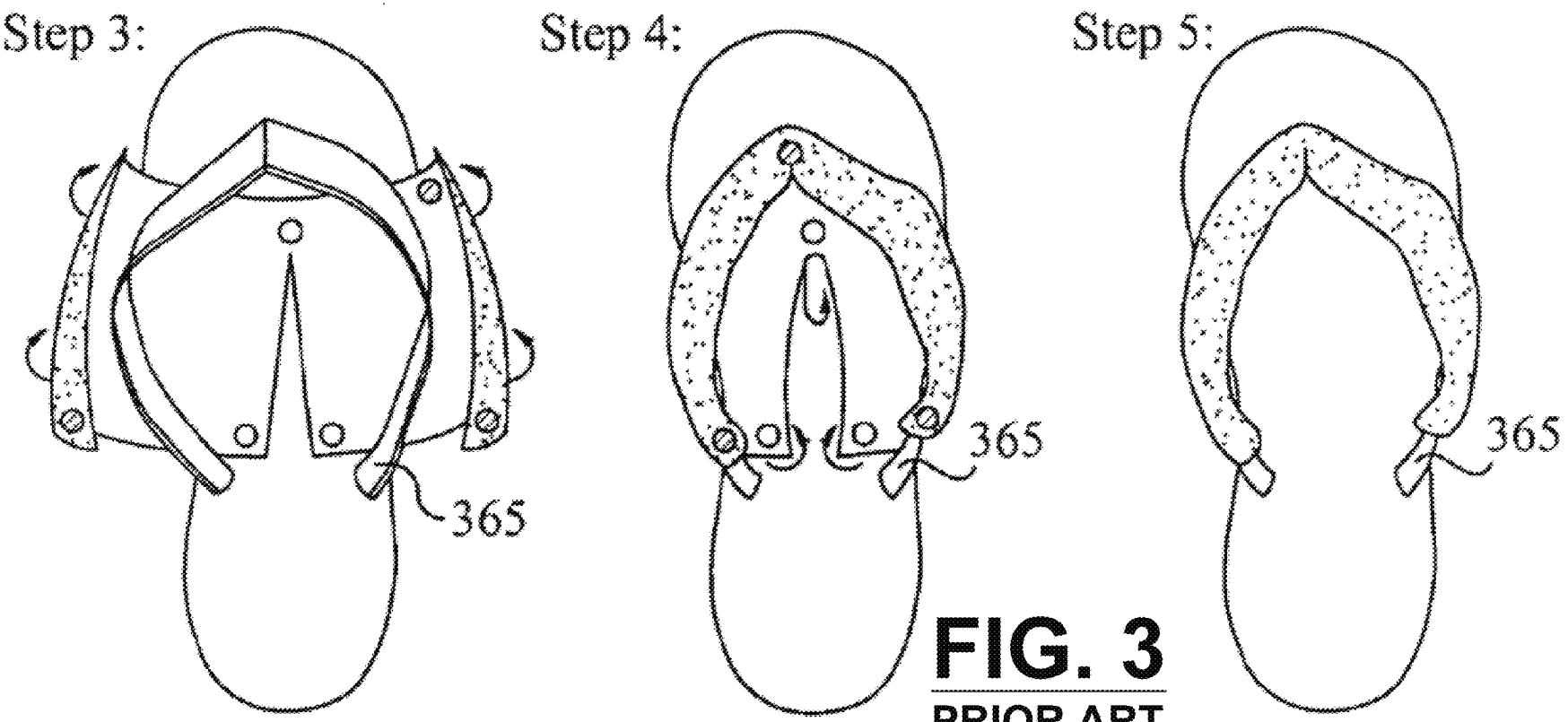
FIG. 3 PRIOR ART
FIG. 3 shows a prior art ornamentation system.
Figure 4:
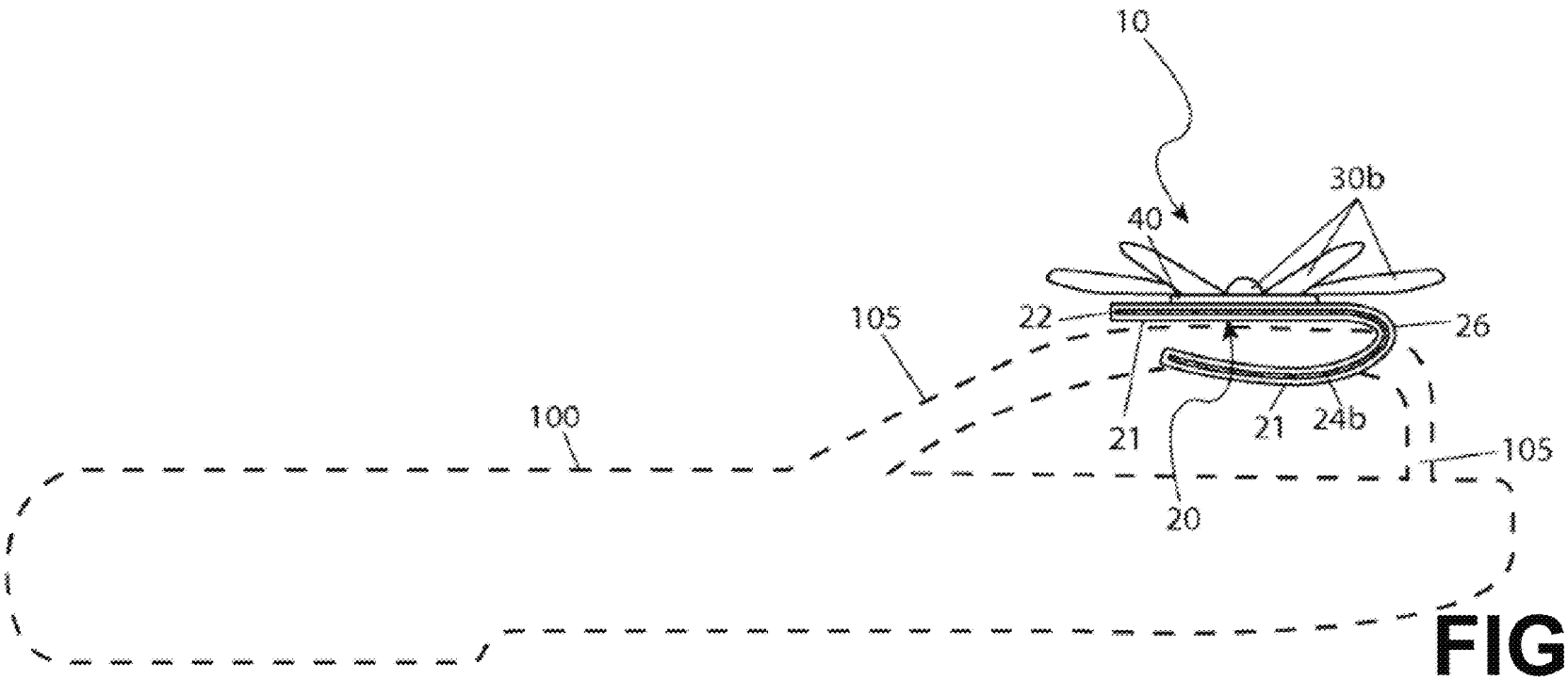
FIG. 4 PRIOR ART
FIG. 4 shows a prior art ornamentation system.
Figure 5:
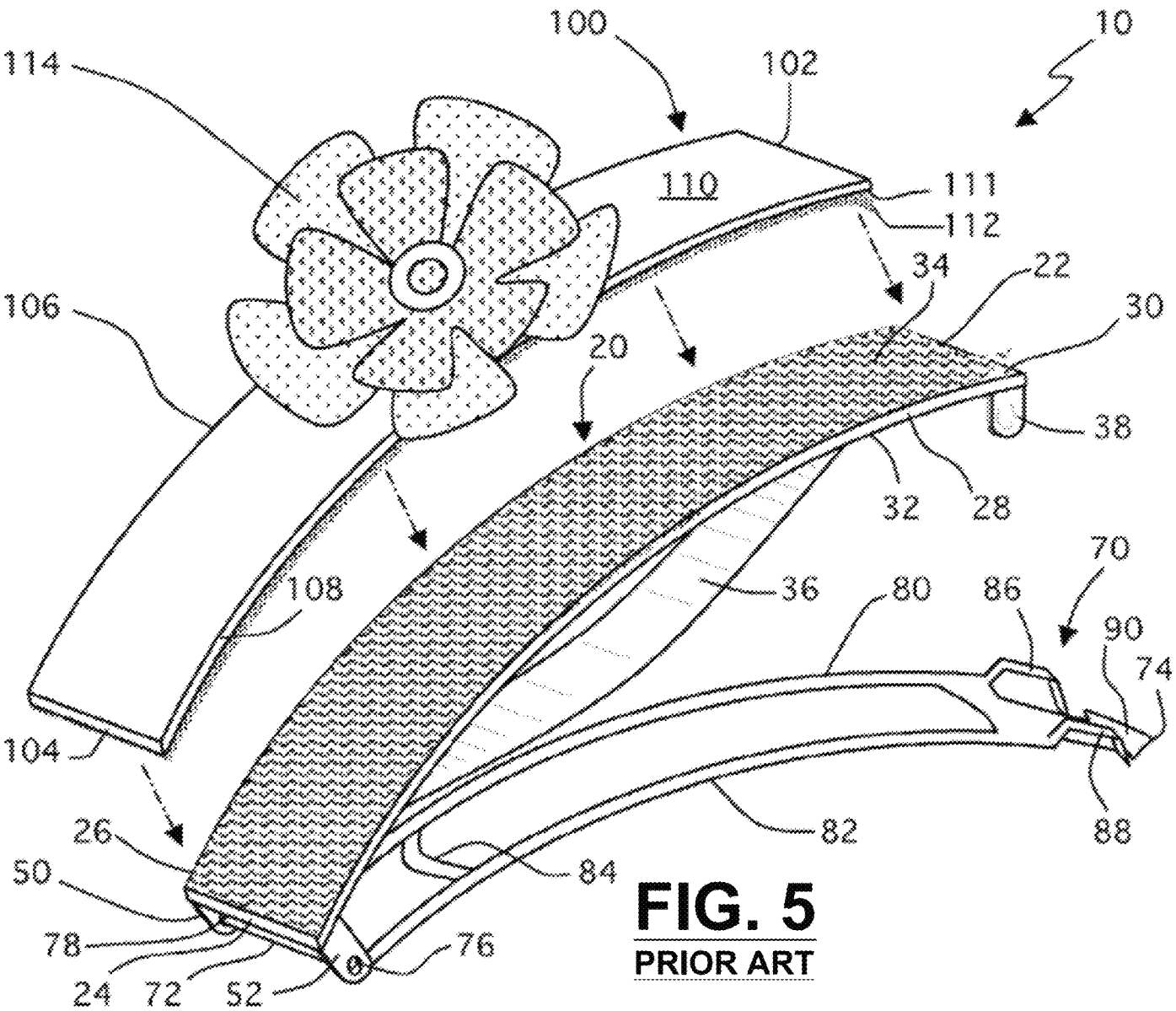
FIG. 5 PRIOR ART
FIG. 5 shows a prior art ornamentation system.
Figure 6:
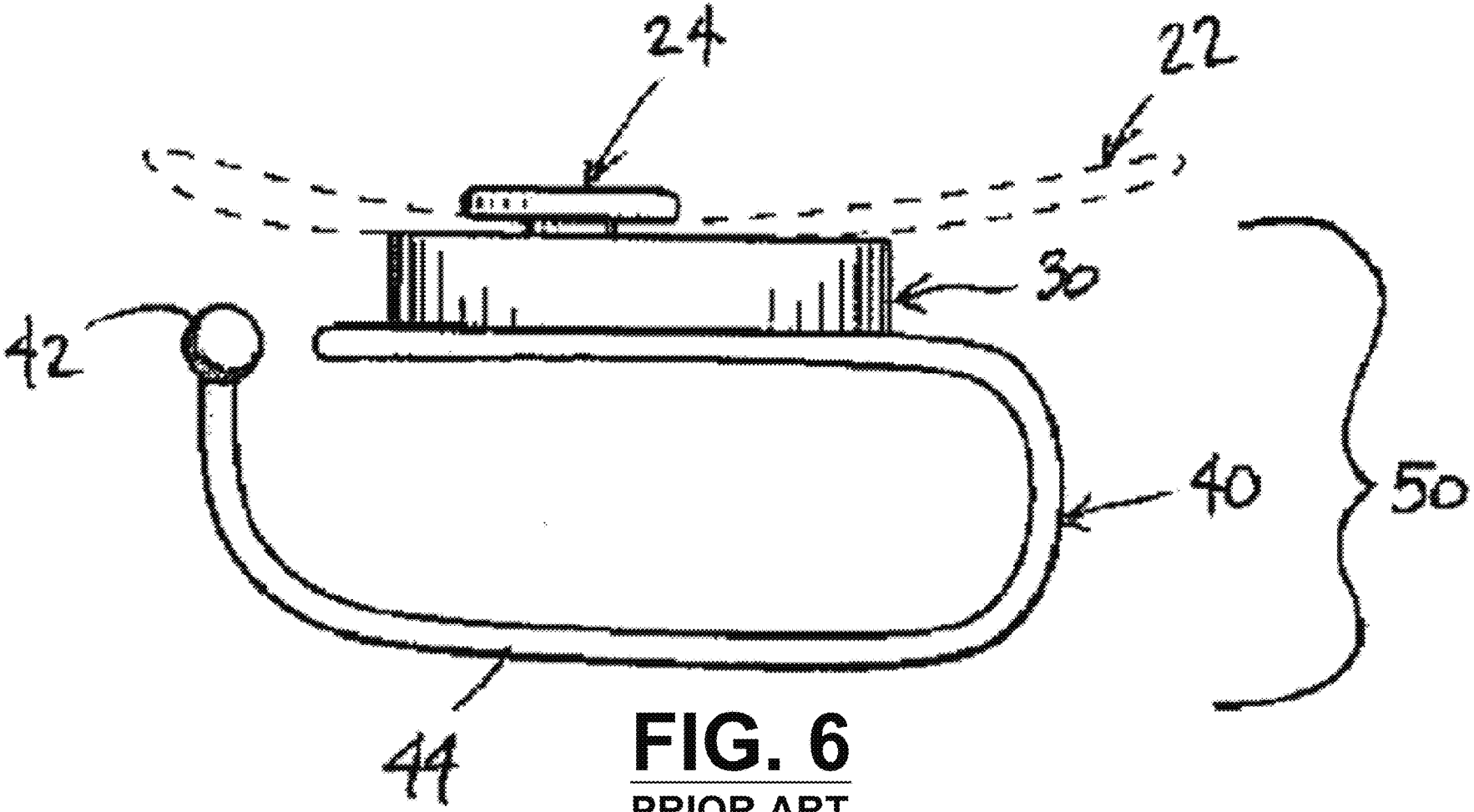
FIG. 6 PRIOR ART
FIG. 6 shows a prior art ornamentation system.
Figure 7:
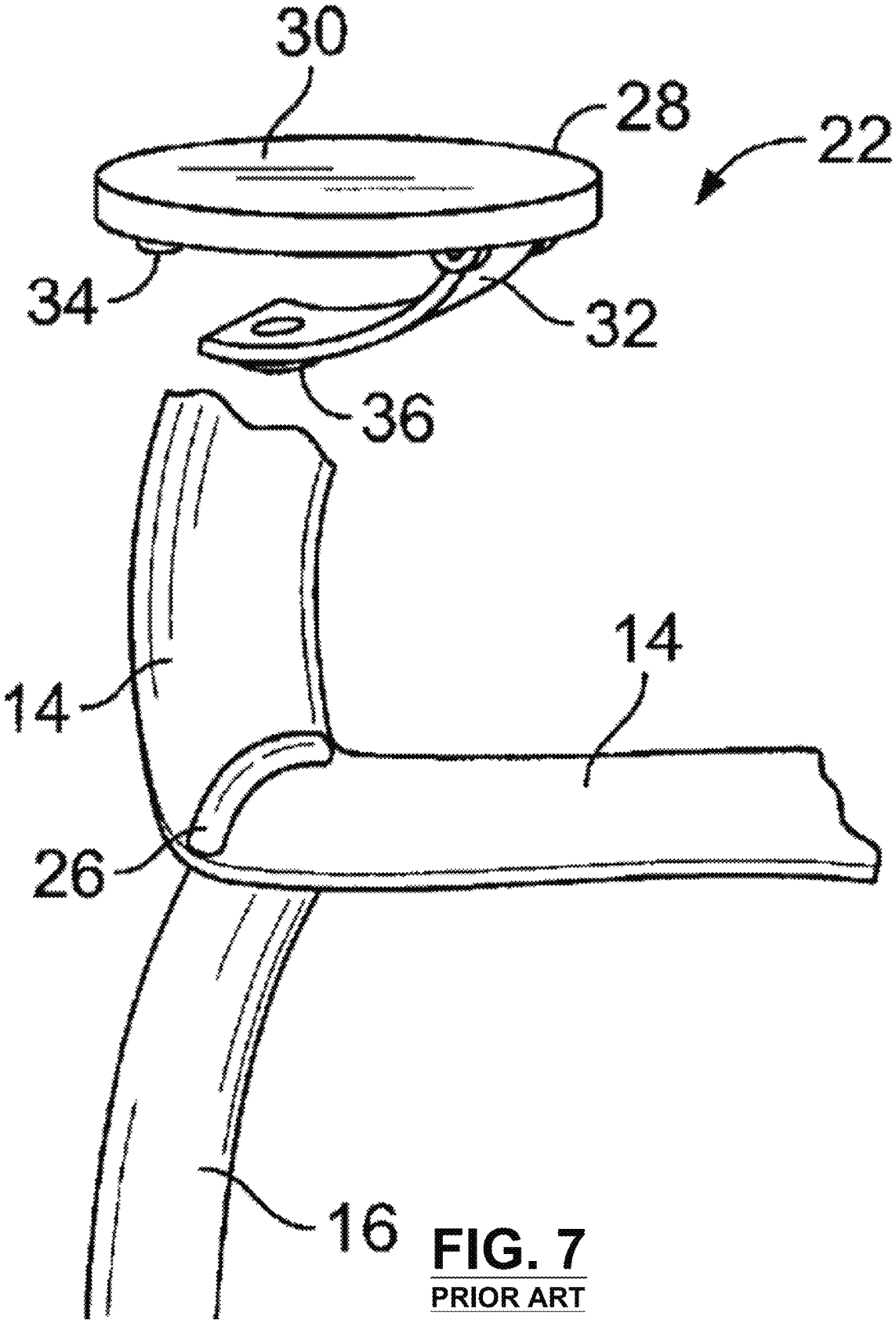
FIG. 7 PRIOR ART
FIG. 7 shows a prior art ornamentation system.
Figure 9:
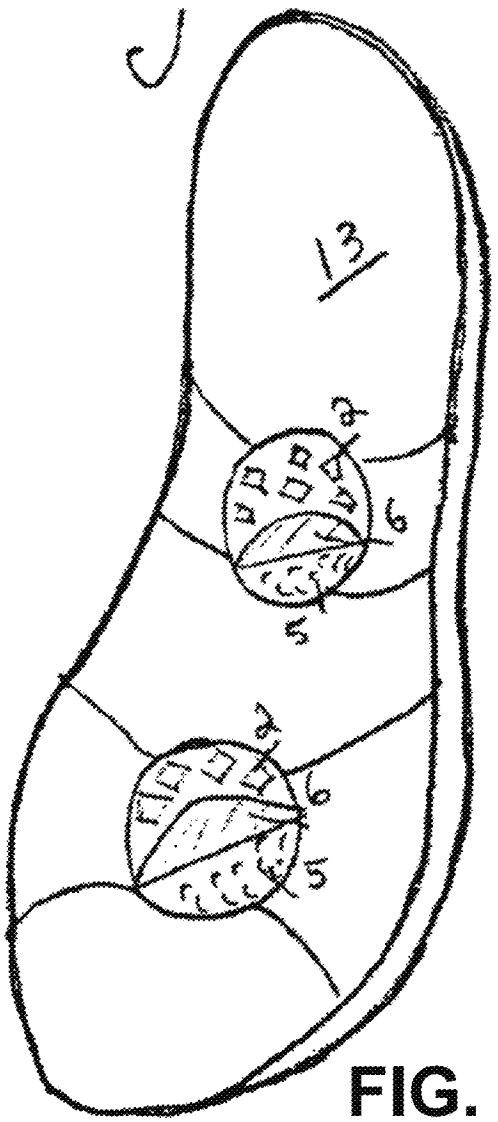
FIG. 9 PRIOR ART
FIG. 9 shows a prior art ornamentation system.
Figure 5A:
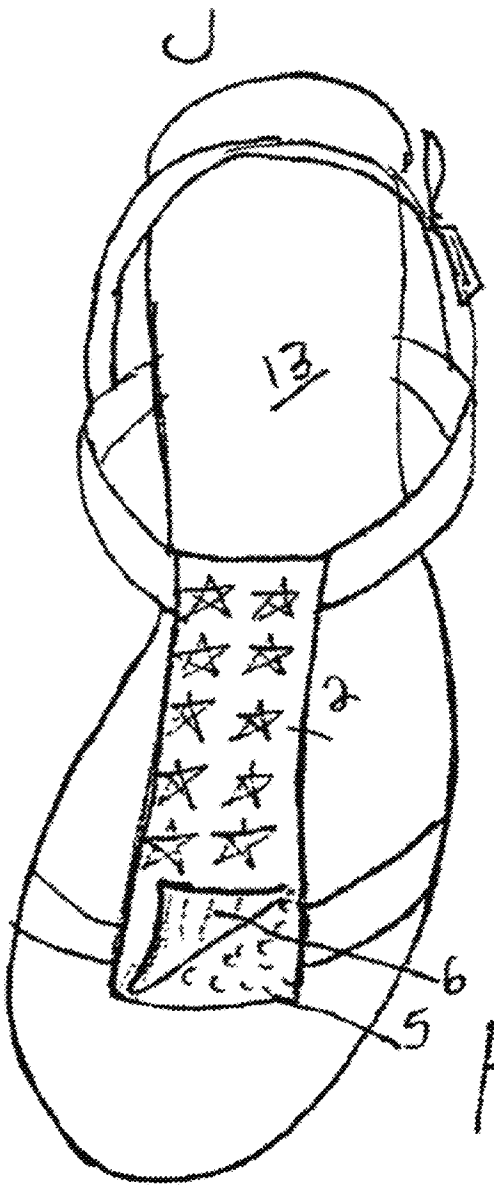
Figure 10:
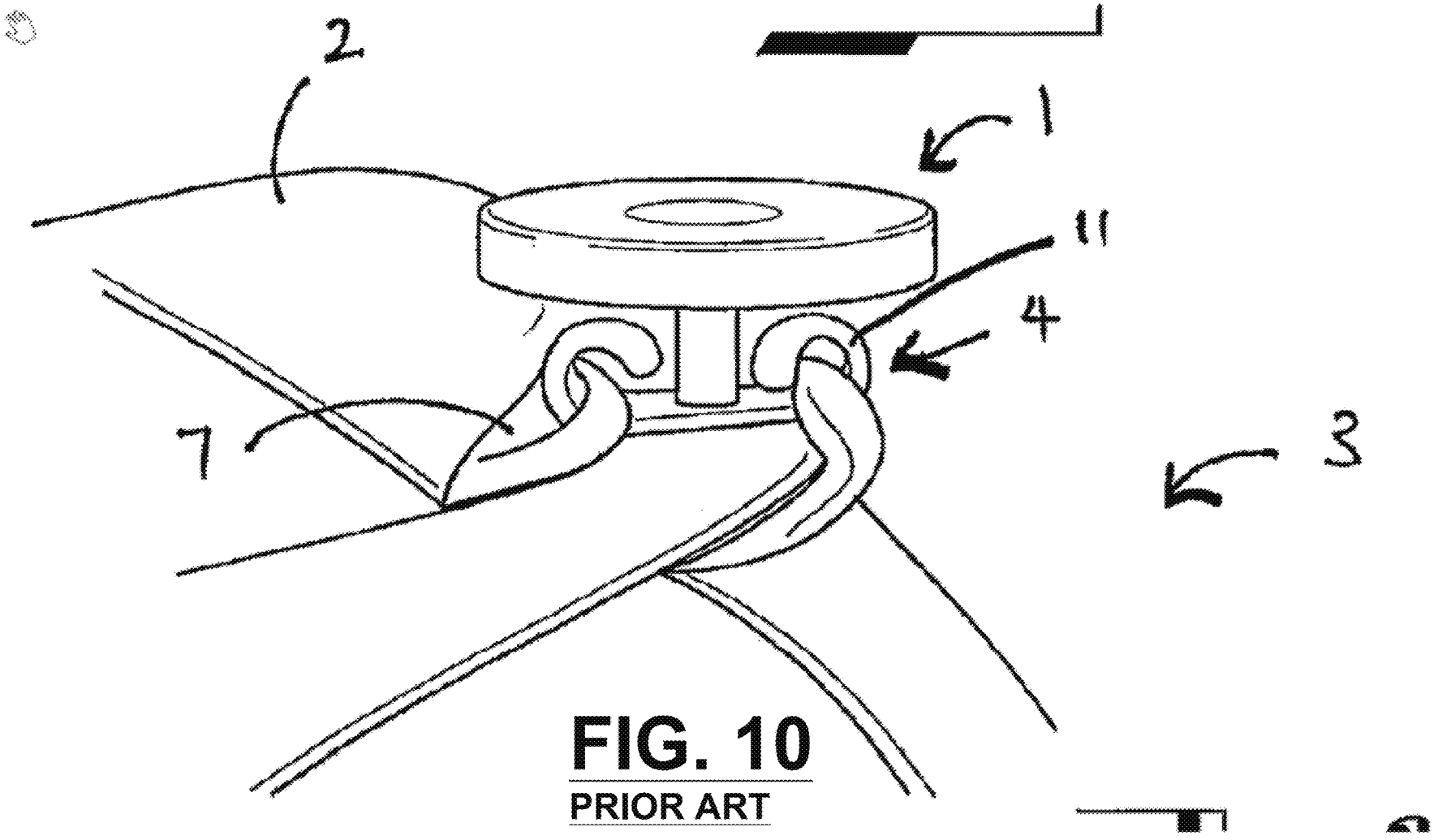
FIG. 10 PRIOR ART
FIG. 10 shows a prior art ornamentation system.
Figure 11:
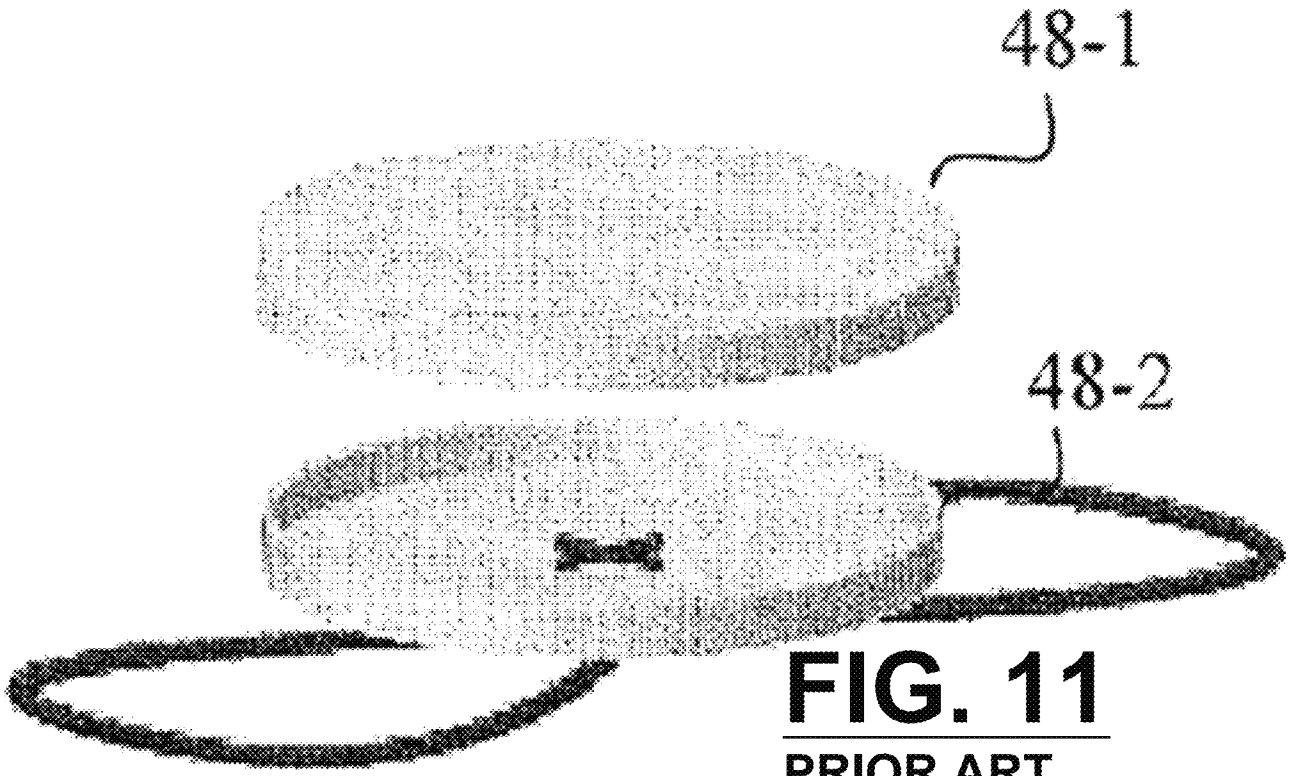
FIG. 11 PRIOR ART
FIG. 11 shows a prior art ornamentation system.
Figures 6A, 6B, 12:
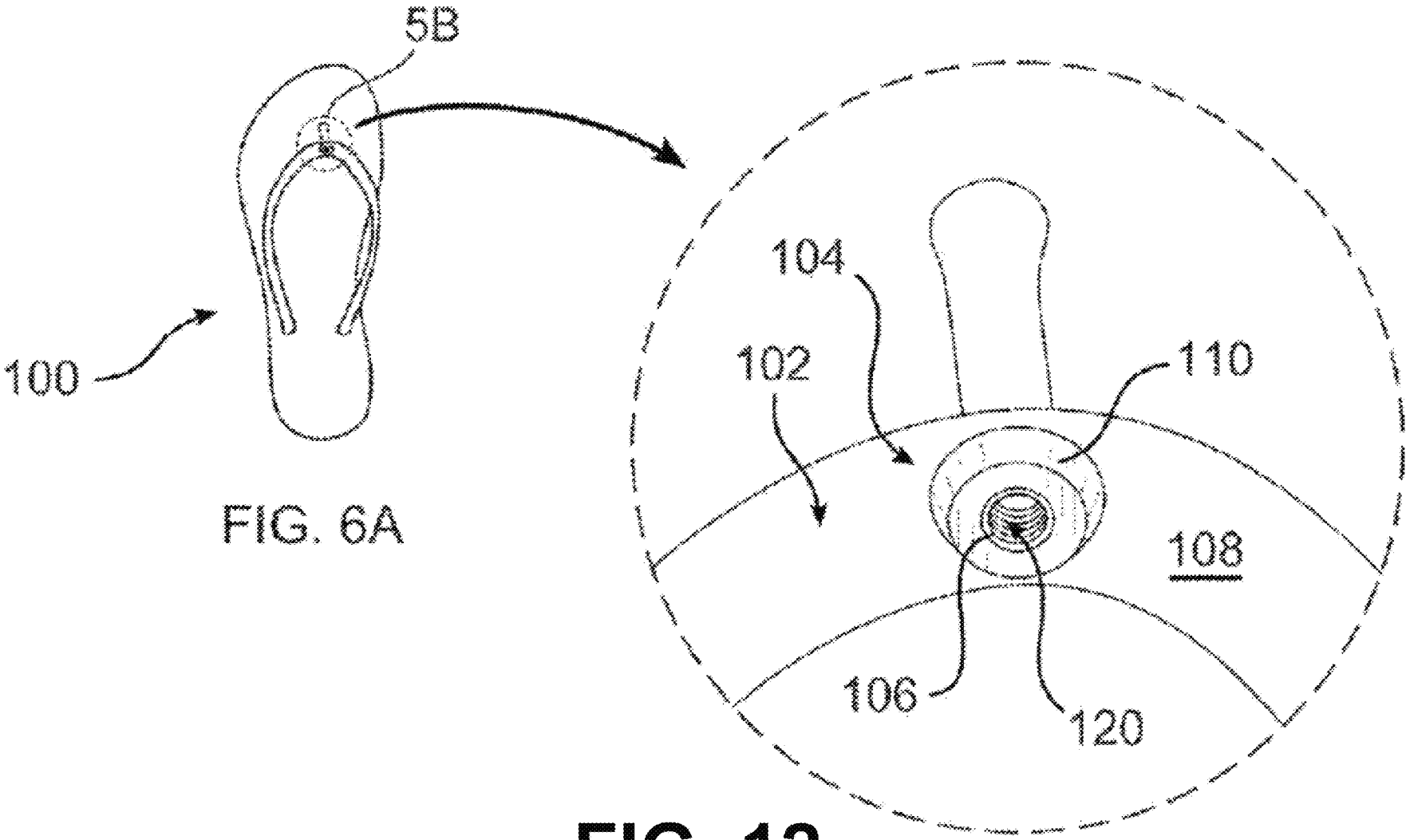
FIG. 12 PRIOR ART
FIG. 12 shows a prior art ornamentation system.
Figure 13:
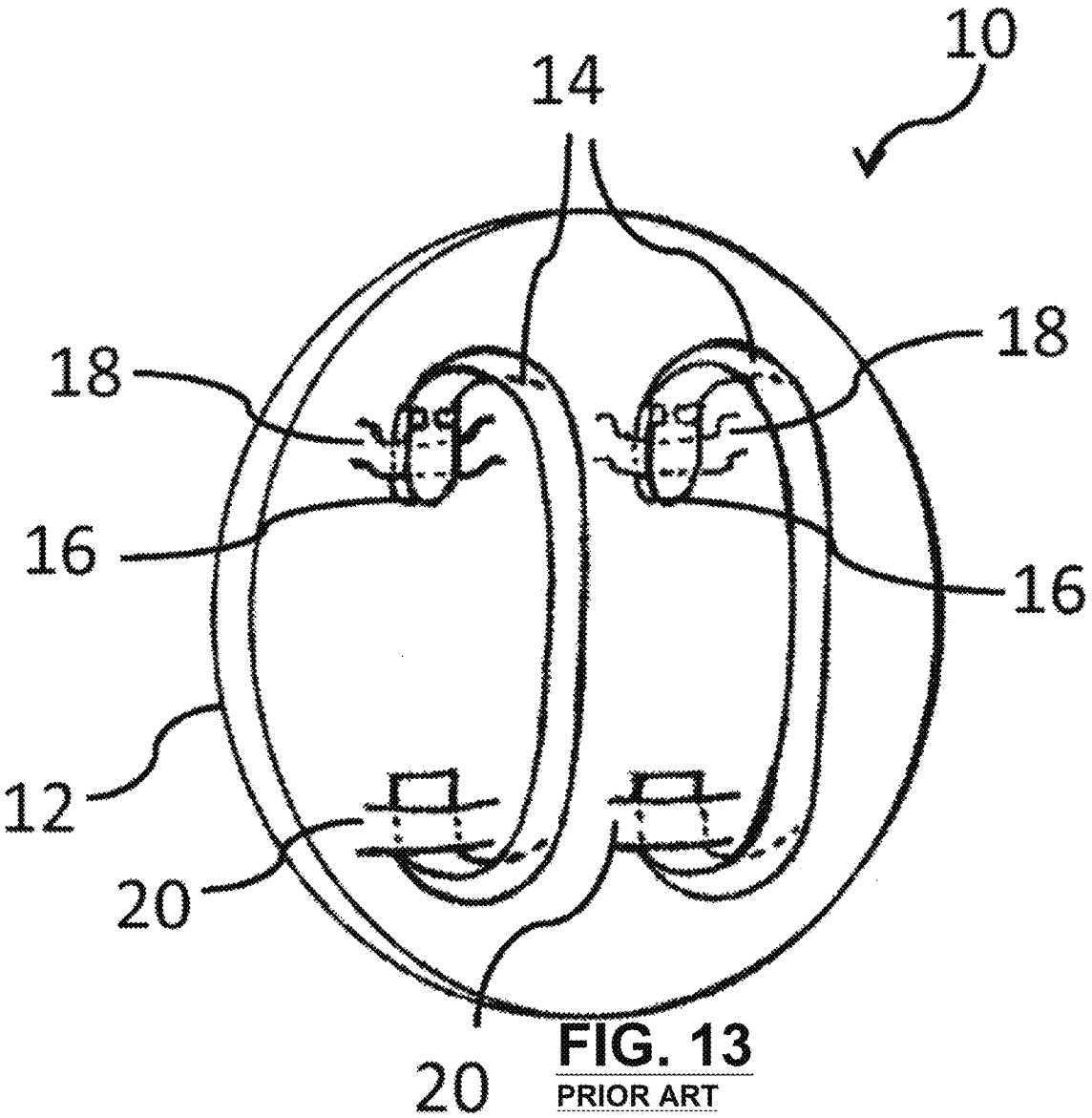
FIG. 13 PRIOR ART
FIG. 13 shows a prior art ornamentation system.
Figure 14:
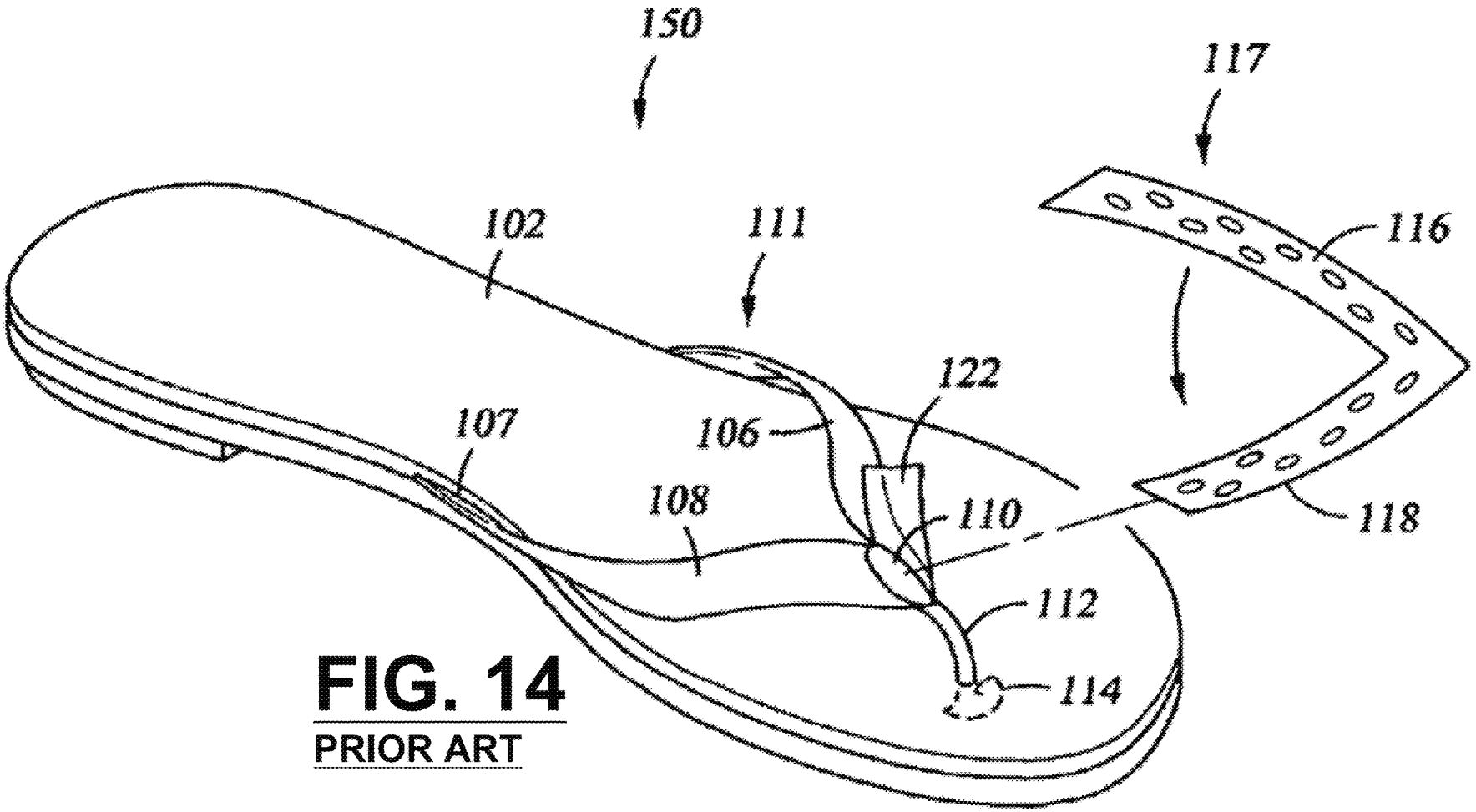
FIG. 14 PRIOR ART
FIG. 14 shows a prior art ornamentation system.

The figures herein are for illustrative purposes only and are not necessarily drawn to scale.

DETAILED DESCRIPTION OF THE EXAMPLE EMBODIMENTS

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y', where 'x' and 'y' are numerical values, includes "about 'x' to about 'y'.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g. given data set, art accepted standard, and/or with e.g. a given confidence interval (e.g. 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used interchangeably herein, the terms "sufficient" and "effective," can refer to an amount (e.g. mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g. a web interface.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the embodiments described herein can be presented as a combination kit. As used herein, the terms "combination kit" or "kit of parts" refers to the embodiments/elements and any additional components that are used to package, sell, market, deliver, and/or provide the combination of elements or a single element. Such additional components include, but are not limited to, packaging, blister packages, and the like. When the embodiments/elements described herein or a combination thereof and/or kit components are not provided simultaneously, the combination kit can contain each embodiment/element or other component in separate embodiments. The separate kit components can be contained in a single package or in separate packages within the kit.

In some embodiments, the combination kit also includes instructions printed on or otherwise contained in a tangible medium of expression. The instructions can provide information regarding the content of kit, safety information regarding the content of the kit, recommendations for use, etc. In some embodiments, the instructions can provide directions and protocols for using the embodiment disclosed herein. In some embodiments, the instructions can methods for use or affixment of the system such as with any of the embodiments described in greater detail elsewhere herein.

Disclosed herein is an interchangeable ornamentation system for a footwear. The interchangeable ornamentation system comprises a base fastener affixed to a base. The base and the base fastener collectively define a foundation. A first strap and a second strap are both pivotally coupled to the base. The first strap and the second strap are both configured to individually couple the foot straps of the footwear for matingly and removable attachment to the base fastener so that the foundation is removably attached to the footwear. A removable ornamentation includes a decorative member and an ornamentation fastener. The decorative member oppositely faces the ornamentation fastener. The ornamentation fastener is configured to matingly and removably attach to the base fastener. Also disclosed herein is a footwear comprising the interchangeable ornamentation system.

Figure 15:
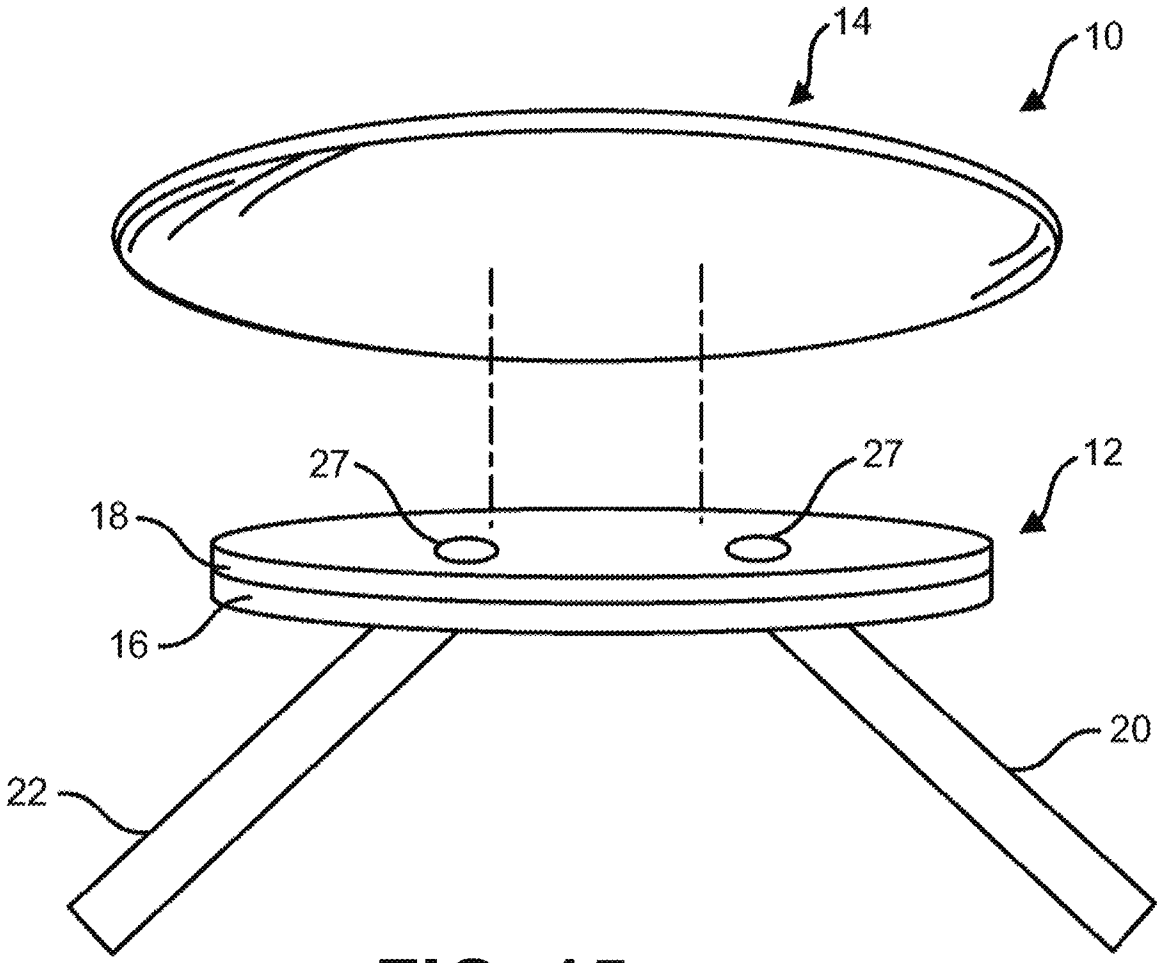
FIG. 15 shows an exploded view of the interchangeable ornamentation system.

Referring now to FIG. 15, an exemplary interchangeable ornamentation system constructed in accordance with the present disclosure is generally referred to by reference numeral 10. The interchangeable ornamentation system 10 provides convenient interchangeability and customization for various footwear such as, but not limited to, flip flops, sandals, and the like. The interchangeable ornamentation system 10 includes a foundation 12 and a removable ornamentation 14.

Figure 16:
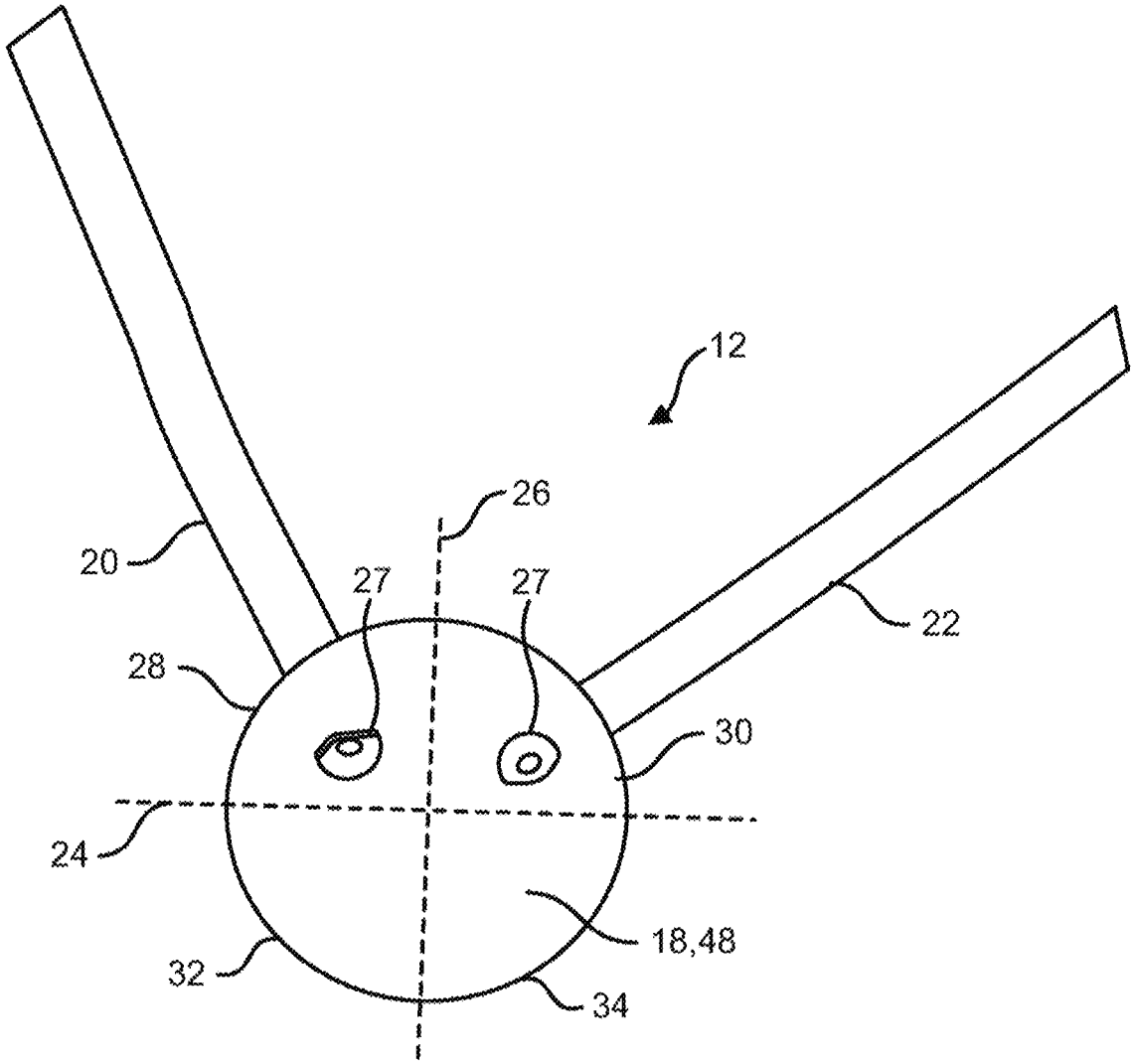
FIG. 16 is a top view of a foundation of the exemplary interchangeable ornamentation system of FIG. 15.
Figure 17:
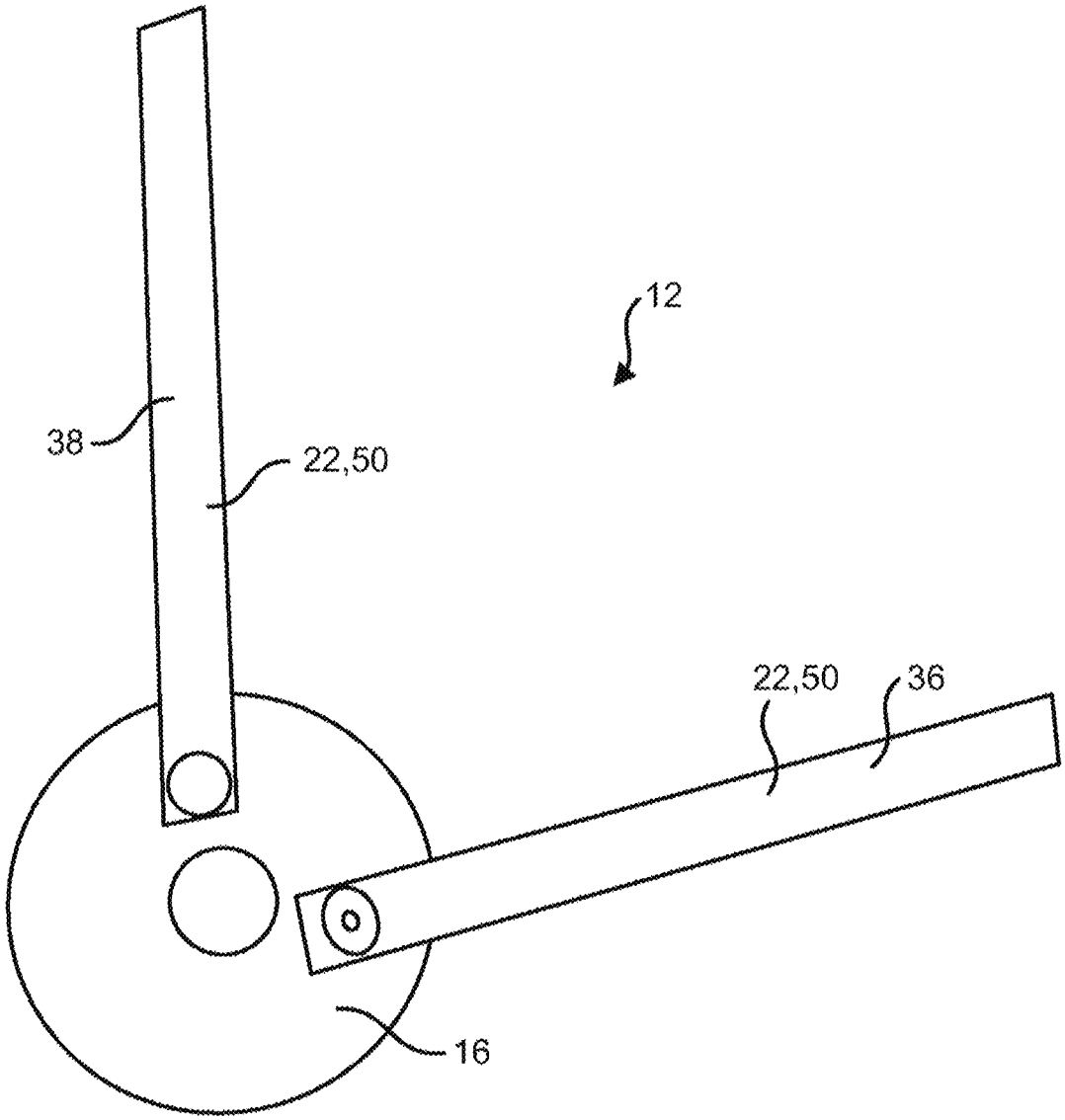
FIG. 17 is a bottom view of the foundation of FIG. 16.

As shown in FIGS. 15-17, the foundation 12 includes a base 16 and a base fastener 18. The base 16 is manufactured of a durable material such as, but not limited to, rubber, neoprene, various types of synthetic rubbers, and other such durable materials well known in the industry.

The base fastener 18 is securely affixed to the base 16 and is designed to removably receive the removable ornamentation 14 in a mating manner as described in more detail below. While the base 16 and the base fastener 18 are shown as disk-shaped, it is to be understood that both the base 16 and the base fastener 18 may be of a wide variety of different shapes such as, but not limited to, square, triangle, star, pentagon, hexagon, and all other well-known shapes. In a preferred embodiment, the base 16 is approximately 2 inches in diameter and approximately 1/16 inches thick and the base fastener 18 is approximately 1 7/8 inches in diameter.

The foundation 12 also includes a first strap 20 and a second strap 22. Both the first strap 20 and the second strap 22 are pivotally coupled to the base 16 of the foundation 12. The pivotal coupling of the first and second straps 20, 22 to the base 16 of the foundation 12 facilitates adjustment when removably attaching the foundation 12 to a footwear. The foundation 12 includes a first axis 24 and a second axis 26 that orthogonally intersects the first axis 24 at a central location on the foundation 12. The intersection of the first axis 24 and the second axis 26 defines a first quadrant 28, a second quadrant 30, a third quadrant 32, and a fourth quadrant 34. In particular, the first strap 20 is pivotally coupled to the base 16 within the first quadrant 28 and the second strap 22 is pivotally coupled to the base 16 within the second quadrant 30. In such a manner, the first strap 20 and the second strap 22 are offset with respect to the first axis 24 of the foundation 12. In a preferred embodiment, the first strap 20 and the second strap 22 are pivotally coupled to the base 16 of the foundation 12 via rivets 27. In such embodiments, a rivet 27 penetrates through the first strap 20, then the base 16, and finally through the base fastener 18 so that a smooth surface of the rivet 27 faces outwardly from the base 16 in the first quadrant 28. The second strap 22 is pivotally coupled to the base 16 in the second quadrant 30 in a similar manner.

The first strap 20 and the second strap 22 include a first strap fastener 36 and a second strap fastener 38, respectively. With the base 16 of the foundation 12 facing upwardly and the first strap 20 and the second strap 22 extending outwardly, as shown in FIG. 17, both the first strap fastener 36 and the second strap fastener 38 also face upwardly. The first strap fastener 36 and the second strap fastener 38 are removably attachable to the base fastener 18. In this way, the foundation 12 is designed for removable attachment to a footwear 40, such as the exemplary flip flop illustrated in FIG. 18. In particular, to removably attach the foundation 12 to the footwear 40, the base 16 of the foundation 12 is generally placed atop the intersection of a first foot strap 42, a second foot strap 44, and a toe strap (not shown in FIG. 18) of the footwear 40 with the first and the second quadrants 28, 30 positioned to substantially face to-ward a toe section 46 of the footwear 40. With the foundation 12 generally positioned in this manner, the first strap 20 loops around the first foot strap 42 to matingly and removably attach to the base fastener 18 and the second strap 22 also loops around the second foot strap 44 to matingly and removably attach to the base fastener 18. In a preferred embodiment, the first strap 20 and the second strap 22 are approximately 5 inches long and approximately ⅜ of an inch wide. In some embodiments, the base fastener 18 includes a plurality of hooks 48, which is matingly and removably attachable to a plurality of strap loops 50 disposed on each of the first strap 20 and the second strap 22.

Figure 18:
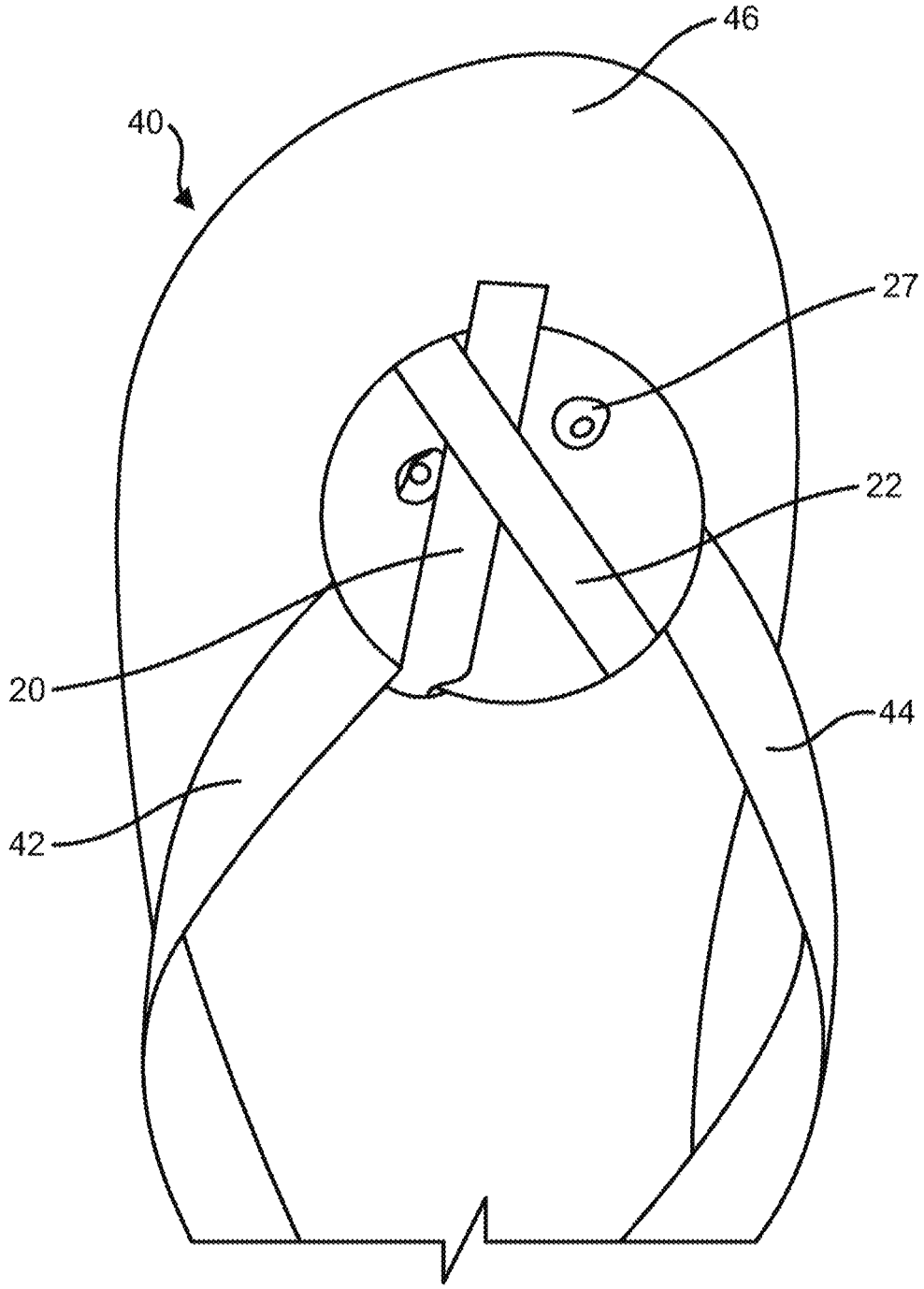
FIG. 18 is a top view of the foundation of the interchangeable ornamentation system of FIG. 16 utilized on an exemplary footwear with a removable ornamentation of the interchangeable ornamentation system removed for clarity.
Figure 19:
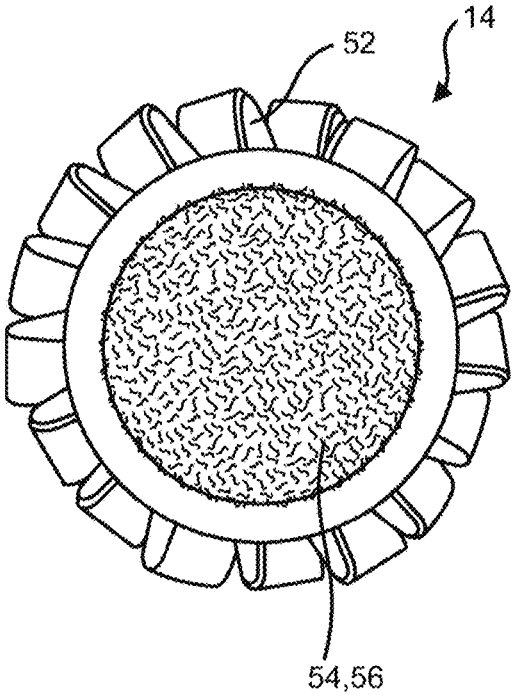
FIG. 19 is a bottom view of a removable ornamentation of the interchangeable ornamentation system of FIG. 15.
Figure 20:
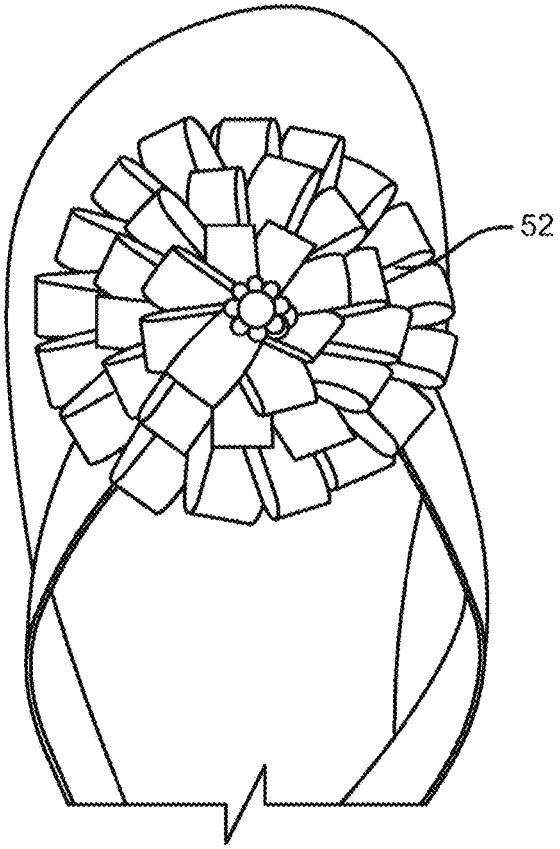
FIG. 20 is a top view of the removable ornamentation of FIG. 5 utilized on an exemplary footwear.

Referring now to FIGS. 19 and 20, the removable ornamentation 14 includes a decorative member 52 and an ornamentation fastener 54 affixed thereto. The decorative member 52 oppositely faces the ornamentation fastener 54. Moreover, the ornamentation fastener 54 is matingly and removably attachable to the base 16 of the foundation 12. In particular, the ornamentation fastener 54 includes a plurality of ornamentation loops 56 that is matingly and removably attachable to the plurality of hooks 48 of the base fastener 18. Accordingly, with the foundation 12 securely, but removably, attached to the footwear 40, as illustrated in FIG. 18, the removable ornamentation 14 is conveniently and removably attached to the base fastener 18 so that the decorative member 52 faces outwardly from the footwear 40 for visual enhancement.

While the first strap fastener 36 and the second strap fastener 38 are also removably attached to the base fastener 18, it should be noted that the width of the strap fasteners 36, 38 are narrow and do not mate with the entirety of the plurality of hooks 48 of the base fastener 18 exposing appropriate portions of the plurality of hooks 48 so that the plurality of ornamentation loops 56 matingly and removably attach to the base fastener 18 as well.

Figure 21:
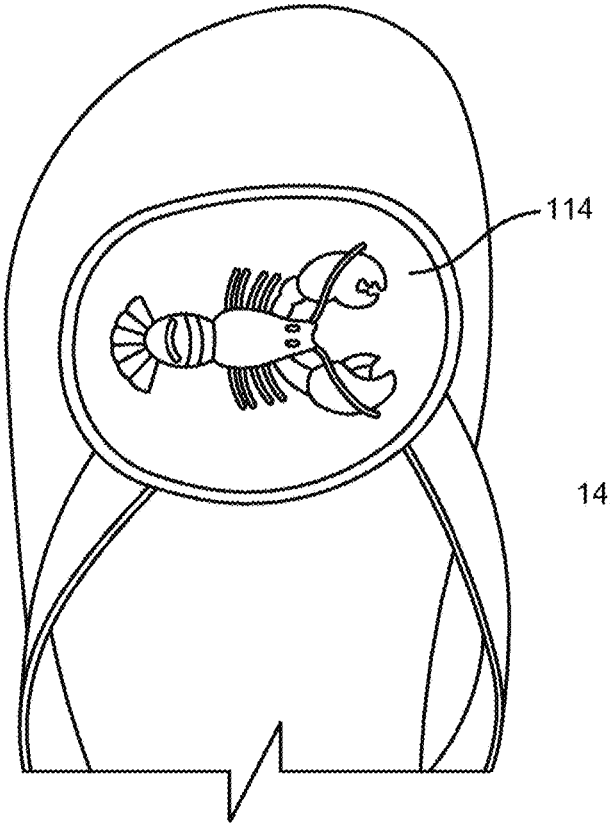
FIG. 21 is a top view of an alternative removable ornamentation utilized with the exemplary footwear of FIG. 18.

As described above, the removable ornamentation 14 is conveniently removable from the foundation 12, which is securely, but removably attached to the footwear 40. With the removable ornamentation 14 removed from the footwear 40, an alternative removable ornamentation 114, as illustrated in FIG. 21, is conveniently removably attached to the foundation 12, which is still securely, but removably attached to the same footwear 40. The interchangeability of different removable ornamentation 14, 114 is limitless as the decorative member 52 can be represented as a wide variety of objects such as, but not limited to, flowers, animals, puffs, buttons, patches, logos, and any other design objects.

Figure 22:
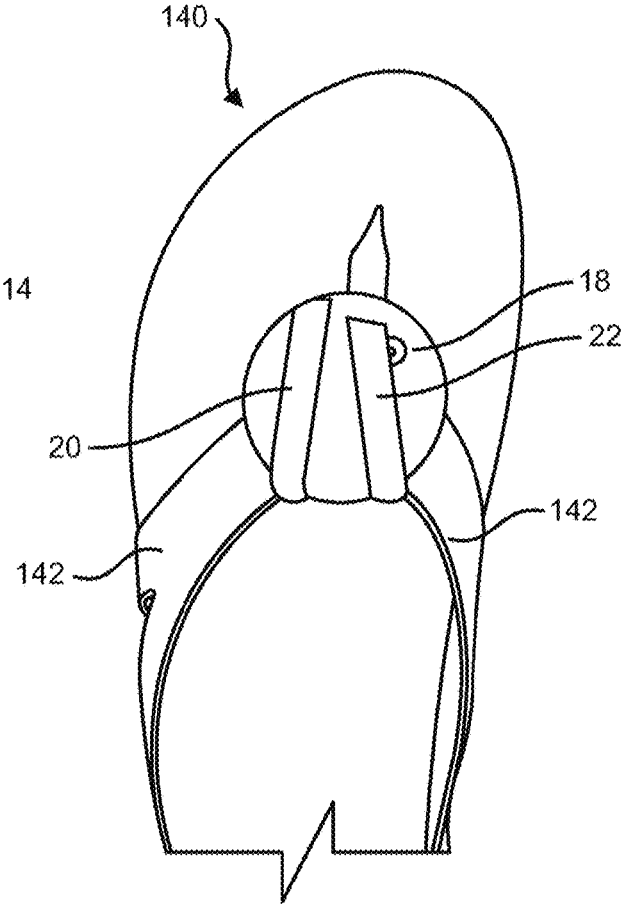
FIG. 22 is a top view of the foundation of FIG. 1 utilized on an alternative exemplary footwear, illustrating wide foot straps, with the removable ornamentation of the interchangeable ornamentation system removed for clarity.

Moreover, the interchangeable ornamentation system 10 not only provides interchangeability of the removable ornamentation 14 with respect to the foundation 12 being removably attached to the footwear 40, but also provides interchangeability between different pairs of footwear as the foundation 12 can be removably attached to any pair of foot-wear such as an alternative embodiment wide-strapped footwear 140 illustrated in FIG. 22. For example, even though the wide foot straps 142 of the wide-strapped footwear 140 are not identical to the strap configuration of the footwear 40, the pivotability of the first strap 20 and the second strap 22, with respect to the base 16 of the foundation 12, allow for adjustability so that the foundation 12 is removably attachable to any type of footwear including footwear 40 and wide-strapped footwear 140. As can been seen, the pivotability of the first strap 20 and the second strap 22 accommodates many various foot strap widths including different sizes for adults and children.

In some instances, a person who is traveling may strategically pack one pair of footwear, such as the footwear 40, along with the interchangeable ornamentation system 10 including a wide variety of different removable ornamentations such as the removable ornamentation 14 and the alternative removable ornamentation 114. The person can easily and removably attach the foundation 12 to the footwear 40 and interchange the removable ornamentation 14 with the alternative removable ornamentation 114 to fit desired needs and match with different outfits. Alternatively, a person could find it desirable to customize a different pair of footwear, such as the wide-strapped footwear 140, and remove the foundation 12 from the footwear 40 and removably attach the foundation 12 to the wide-strapped footwear 140.

With the foundation 12 removably attached to the wide-strapped footwear 140, the person can conveniently interchange a wide variety of removable ornamentations onto the foundation 12, such as the removable ornamentation 14 and the alternative removable ornamentation 114.

In a further embodiment, further improvements to the ornamentation system of the current disclosure may be provided, such as eliminating the use of a disk or other hard surface to which ornamentation is affixed. A hard, or even rigid pliable material, may be too hard and could rub on and irritate the user. Further, rivets may also be eliminated in order to further reduce abrasion and "catch" points as well as to simplify construction. The size of the system may also be changed, such as from reducing the size of the foundation from 1⅞" to 1⅜". This smaller size provides for more options one has to affix smaller bling ornamentation. Further, both surfaces of the foundation may be able to affix the straps and a "sandwich" construct can serve to secure the straps without the need for rivets or other joining material. Further, given the significant improvements in the shear and peel strength of VELCRO® and other such designed/fixed surface adhesives, the further embodiment improves both adhesion of ornamentation as well as improves the ability to "grab" the shoe structure more tightly and securely.

There are many manufacturers of shoes such as flip flops with bling ornamentation permanently attached. While some companies do provide interchangeable systems, these only function with that precise style of footwear sold with the system, thus preventing use with other styles/brands of shoes. Further, there are limitless possibilities for bling ornamentation and bling sizes with the Flipping Bling™ ornamentation system of the current disclosure. The Flipping Bling™ system, in one aspect, may be designed and sized to camouflage the imperfections in one's feet (bunions, crooked toes, etc.). Other commercially available systems, however, have only straps with a small ornamentation that does nothing to cover/camouflage imperfections.

Figure 23:
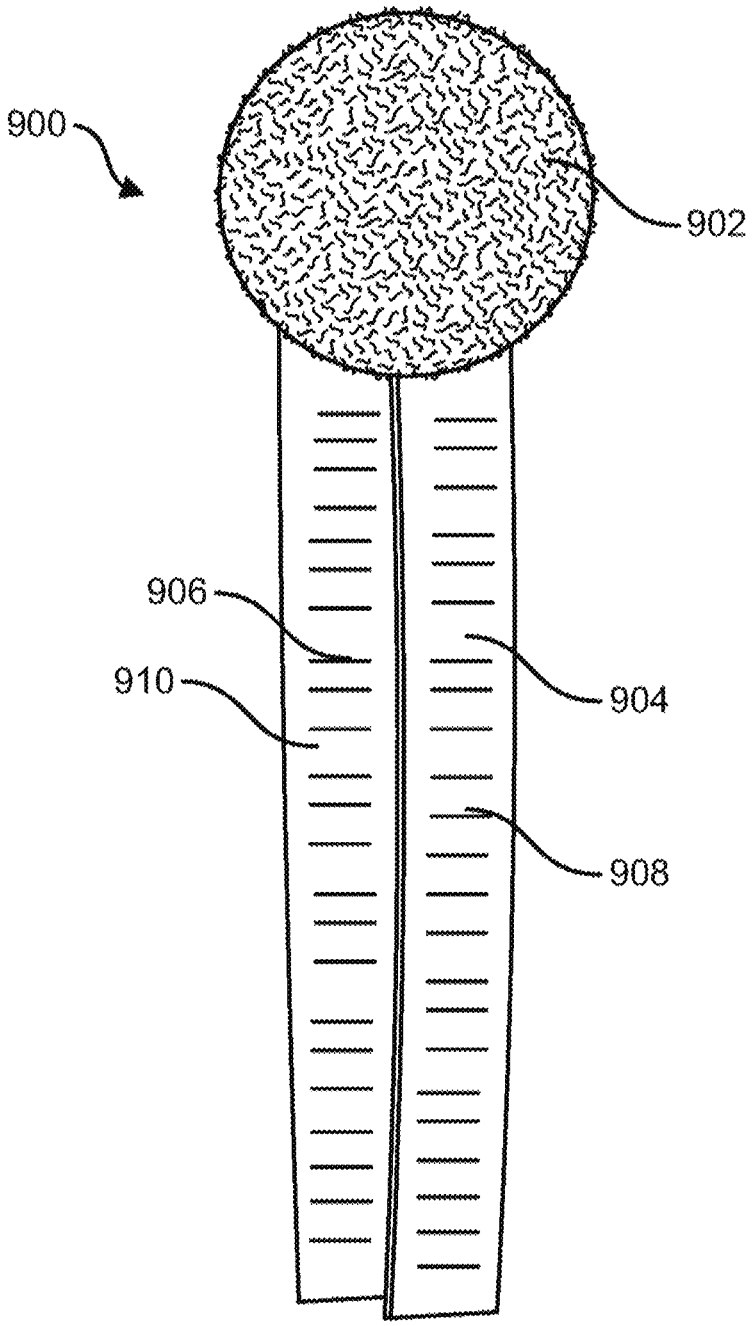
FIG. 23 illustrates one embodiment of an ornamentation affixer substrate laid flat.
Figure 24:
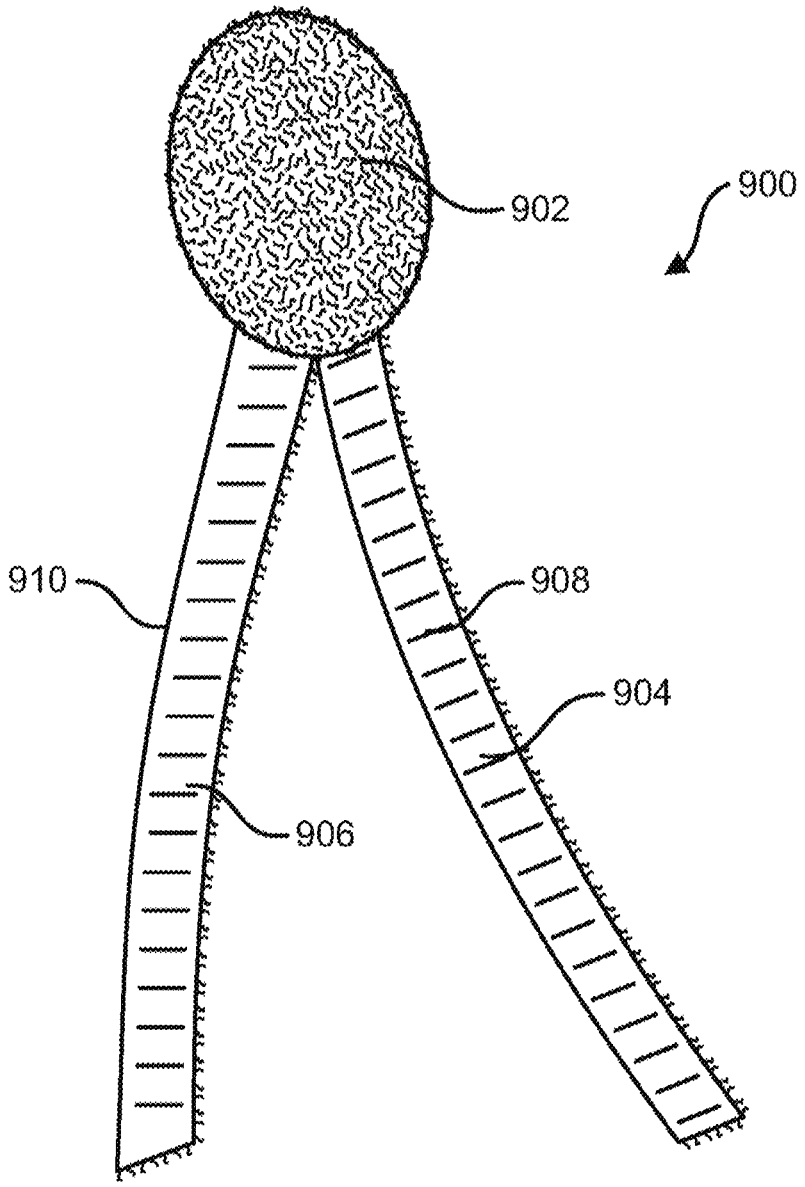
FIG. 24 illustrates a perspective side view of one embodiment of an ornamentation affixer substrate.
Figure 25:
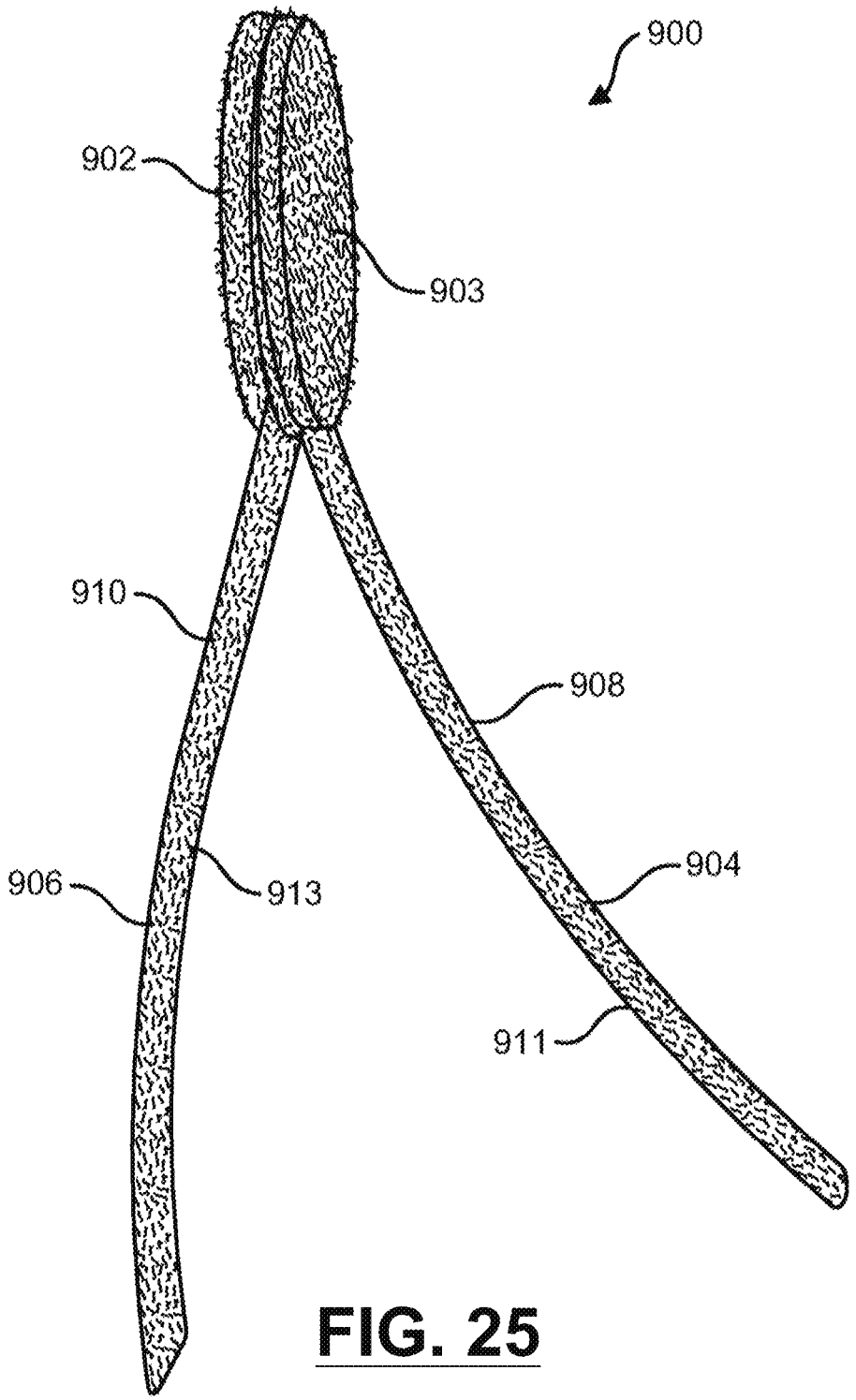
FIG. 25 is a straight on side view of one embodiment of an ornamentation affixer substrate.
Figure 26:
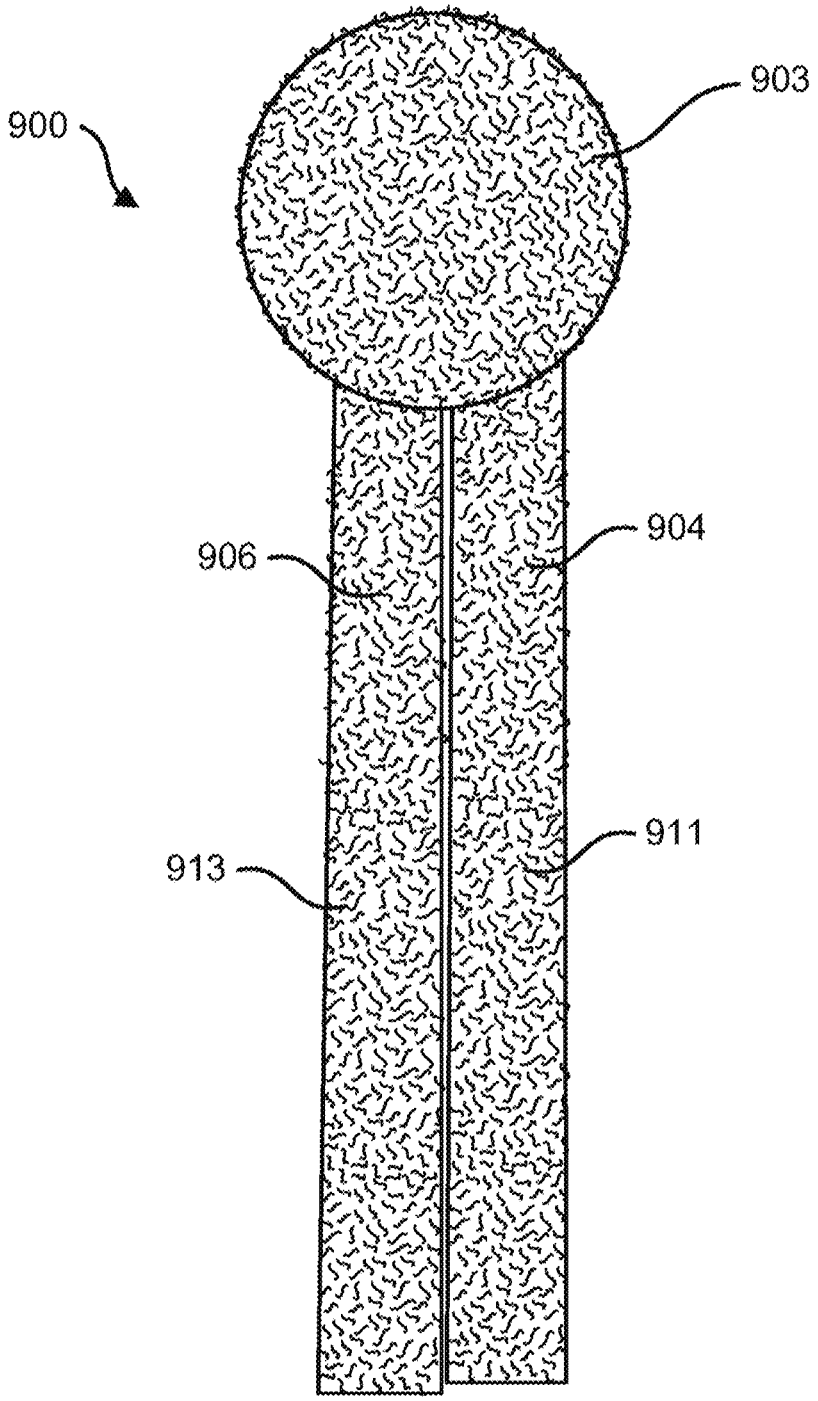
FIG. 26 is a back view of one embodiment of an ornamentation affixer substrate.

FIG. 23 illustrates ornamentation affixer substrate 900 laid flat showing the upper surface of ornamentation affixer substrate. FIG. 24 illustrates a perspective side view of ornamentation affixer substrate 900. FIG. 25 is a straight on side view of ornamentation affixer substrate 900. FIG. 26 is a back view of ornamentation affixer substrate 900. Affixer substrate 900 may include upper surface 902, first affixment arm 904, and second affixment arm 906. Upper surface 902 may be formed from hook and loop fasteners, hook and pile fasteners, or touch fasteners, including but not limited to VELCRO® materials, such as Hook 88, Hook 65, Hook 81, ULTRA-Mate® brand hooks, high technology hook surfaces, such as HTH 888, HTH 805, HTH 704, HTH 705, HTH 706, HTH 711, HTH 745, HTH 751, HTH 757, HTH 758, HTH 811, HTH 833, HTH 841, HTH 845, HTH 848, etc., DUAL LOCK® from 3M. In one embodiment, upper surface 902 and lower surface 903, see FIG. 25, may be positioned to both be the "hook" or both be the "loop" sides of fasteners such as VELCRO®, further, upper surface 902 and 903 may be fastened such that one is the "hook" and one is the "loop" surface. Still further, when using a substance such as DUAL LOCK® from 3M, all surfaces may have the same surface texture and engage at any points where the upper substrate 902, lower substrate 903, first affixment arm 904, or second affixment arm 906 engage one another, regardless of the "top" or "bottom" orientation of the surfaces in contact. Indeed, first affixment arm 904 and second affixment arm 906 can engage their own respective surfaces to provide for further attachment improvements and holds with respect to various sized and styled footwear.

In a preferred embodiment, upper substrate 902, lower substrate 903, 1st affixment arm upper surface 908, and second affixment arm upper surface 910 may be formed from the "loop" side of VELCRO® or other similar fasteners. This provides a soft surface, unlike the more rigid "hook" surface, for contacting the wearer's skin and articles of clothing that may come into contact with affixer substrate 900, thereby reducing picks and catching of the fabric or other items. Meanwhile, first affixment arm lower surface 911 and second affixment arm lower surface 913 may be formed from the "hook" surface of VELCRO® or other such fasteners in order to provide a mating surface to "grab" and hold onto the "loop" material forming the engaging surface.

Figure 27:
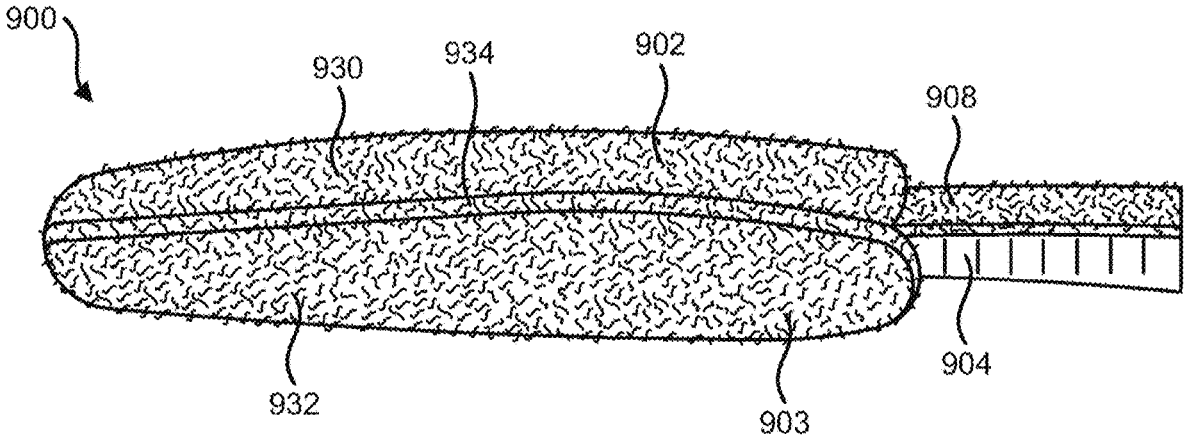
FIG. 27 shows a close-up view of the side view of one embodiment of an ornamentation affixer substrate.

FIG. 27 shows a close-up view of the side view of ornamentation affixer substrate 900. Upper disk 930 and lower disk 932 form joint boundary 934, which may be formed via joining upper disk 930 and lower disk 932 together via adhesive, heat bonding, etc., secure distal end 936 of first affixment arm 904, as well as second affixment arm 906, between upper disk 930 and lower disk 932. Upper disk 930 and lower disk 932 may be joined together by glue such as using Duragrip® 'coins' which have a rubber adhesive on one side. One can simply place one 'loop' coin on a flat surface, lay two Velcro® Brand One-Wrap® Tape pieces on top of the glued surface, then stick another Duragrip® 'loop' coin on top of that. Thus, the Velcro® Brand One-Wrap® Tape straps are sandwiched between the two Duragrip® coins. Further, upper disk 930 and lower disk 932 may be stitched together to join them.

Figure 28:
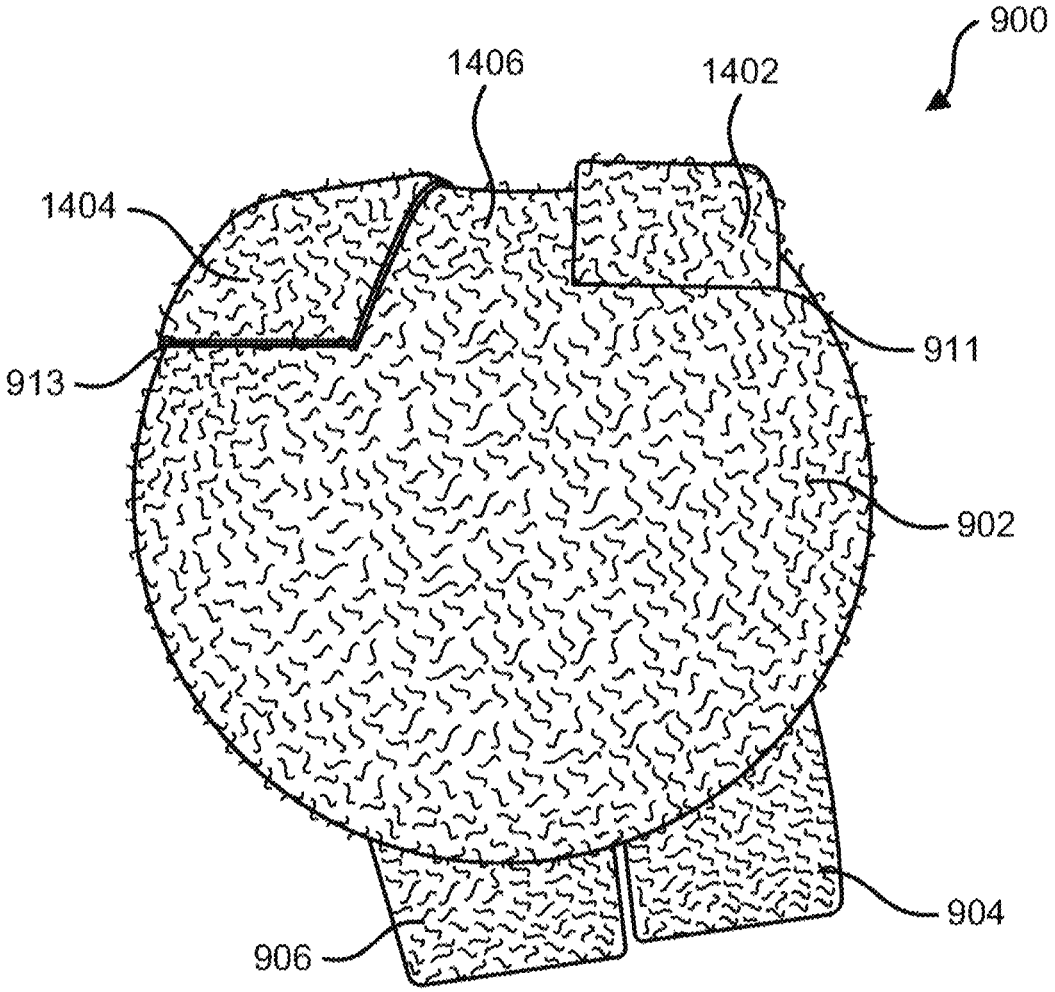
FIG. 28 shows one embodiment of an ornamentation affixer substrate with a first affixment arm and a second affixment arm attached to ornamentation affixer a substrate upper surface.
Figure 29:
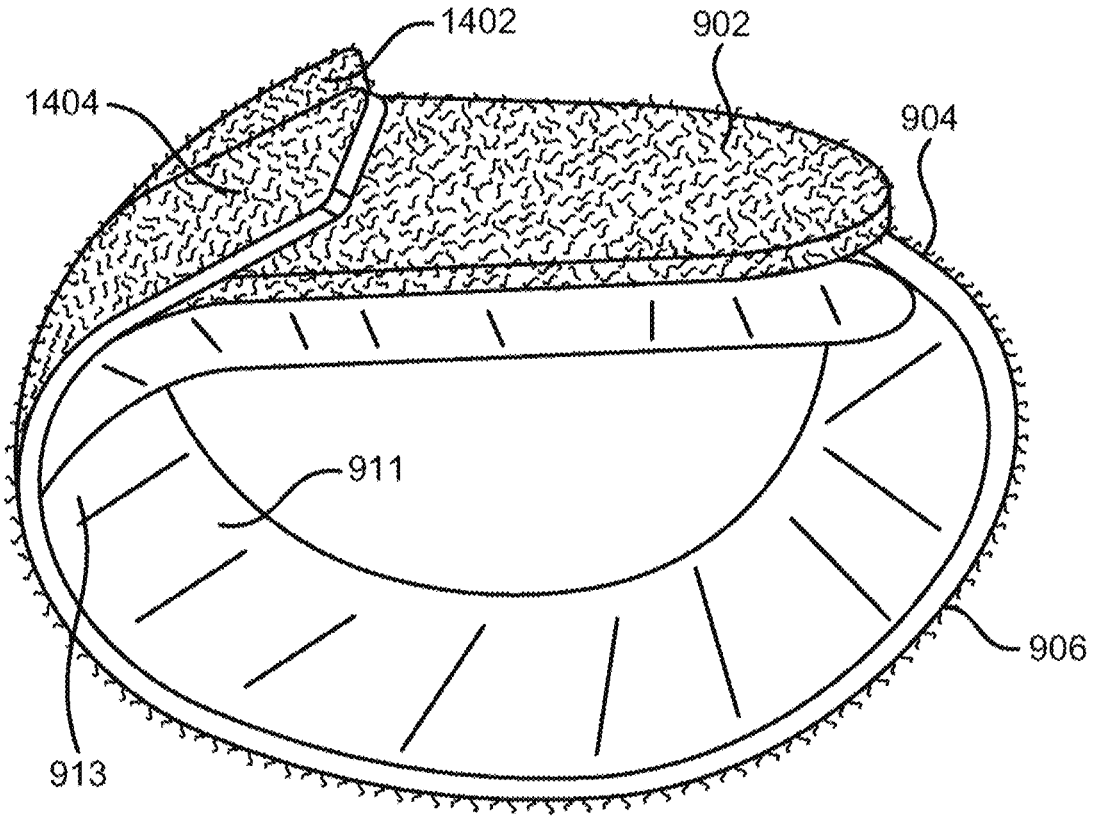
FIG. 29 shows a side view of FIG. 28.
Figure 30:
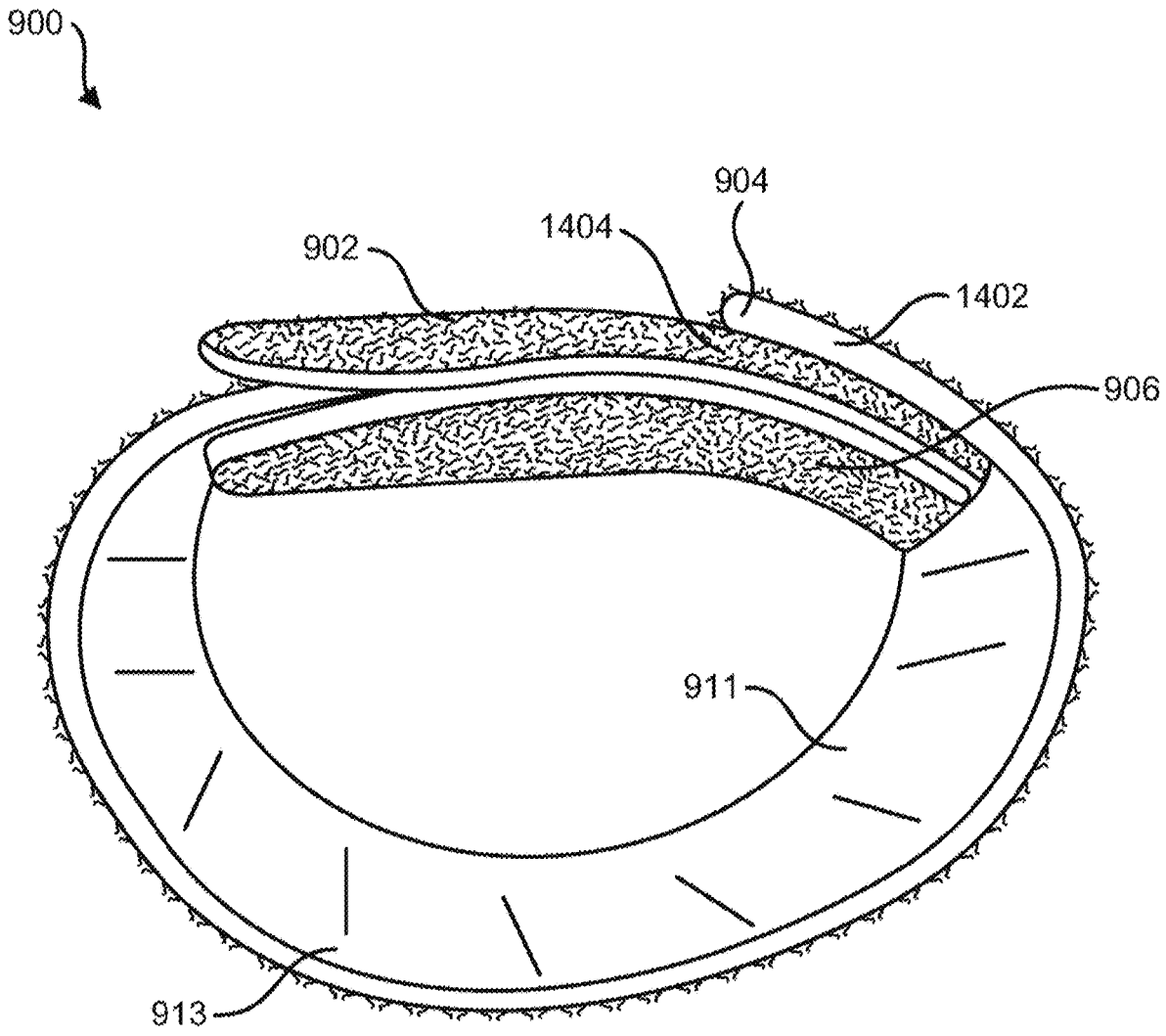
FIG. 30 is an opposite side view of FIG. 29.

One convenient aspect of this embodiment is that ornamentation affixer substrate 900 does not require additional mechanisms/fixtures/attachments to be secured to footwear. Indeed, first affixment arm 904 and second affixment arm 906 may attach anywhere to upper surface 902 and/or lower surface 903, such as adjacent to edge opposite arm affixment 1406. First affixment arm 904 and second affixment arm 906 may be formed to be pliable and thus capable of twisting, contorting, bending, flexing, etc., with respect to one another and supper surface 902 and lower surface 903. Further, First affixment arm 904 and second affixment arm 906 may be formed to affix to one another along their respective surfaces. This variability allows ornamentation affixer substrate 900 to be used with a very wide variety of footwear. FIG. 28 shows ornamentation affixer substrate 900 with first affixment arm 902 and second affixment arm 906 attached to upper surface 902 via first affixment arm distal end 1402 and second affixment arm distal end 1404 allowing first affixment art lower surface 911 and second affixment art lower surface 913 to engage with upper surface 902. FIG. 29 shows a side view of FIG. 28. FIG. 30 is an opposite side view of FIG. 28.

Figure 31A:
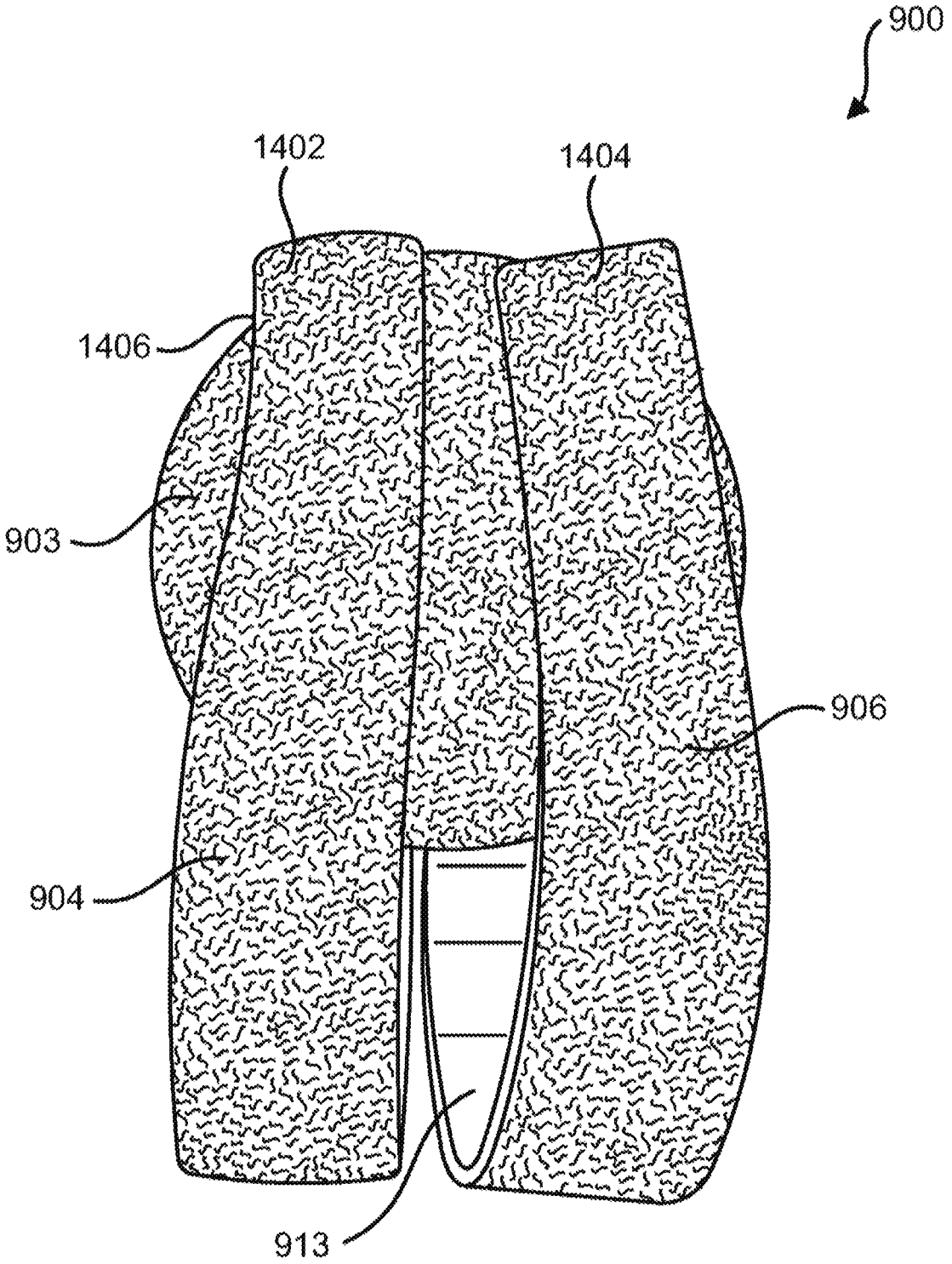
FIG. 31A shows an alternate affixment arrangement for an ornamentation affixer substrate of the present disclosure.
Figure 31B:
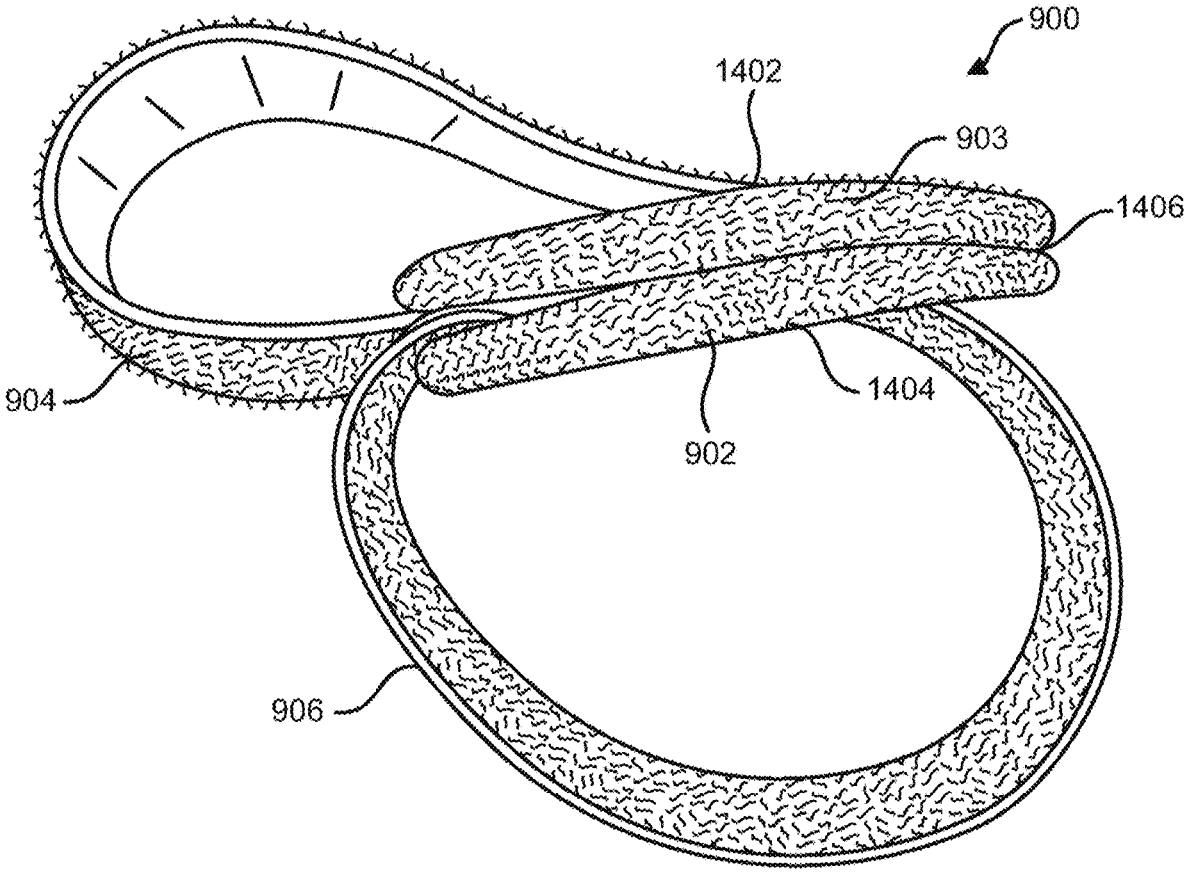
FIG. 31B shows a further alternate affixment configuration wherein a first affixment arm is attached to a lower substrate while a second affixment arm is simultaneously affixed to an upper surface of an ornamentation affixer substrate.
Figure 32:
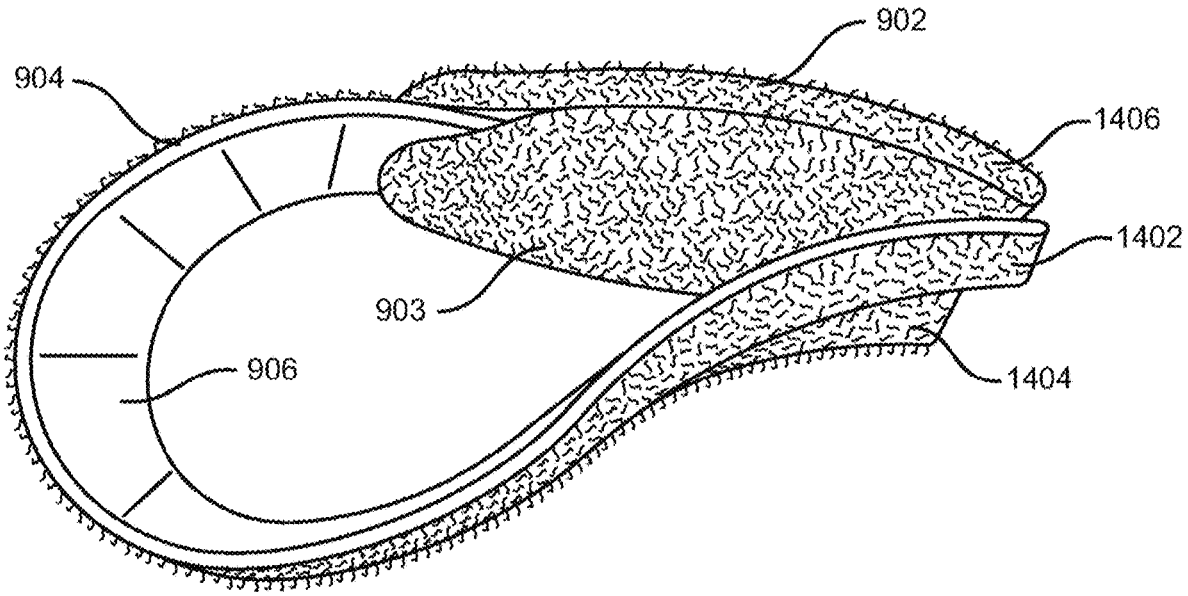
FIG. 32 is a side view of FIG. 31A.

FIG. 31A shows an alternate affixment arrangement wherein first affixment arm 904 and second affixment arm 906 may attach to a different location on lower substrate 903, such as adjacent to edge opposite arm affixment 1406. As mentioned previously, first affixment arm 904 and second affixment arm 906 may attach to any portion of upper surface 902 and/or lower substrate 903. Indeed, the arms may be positioned roughly parallel to another, spaced from one another, or placed randomly on upper surface 902 with respect to one another providing for a wide variety of attachment locations and positions not present in other devices. FIG. 31B shows an attachment configuration wherein 1st affixment arm 902 is attached to lower substrate 903 while second affixment arm 906 is simultaneously affixed to upper surface 902. FIG. 32 is a side view of FIG. 31A.

Figure 33:
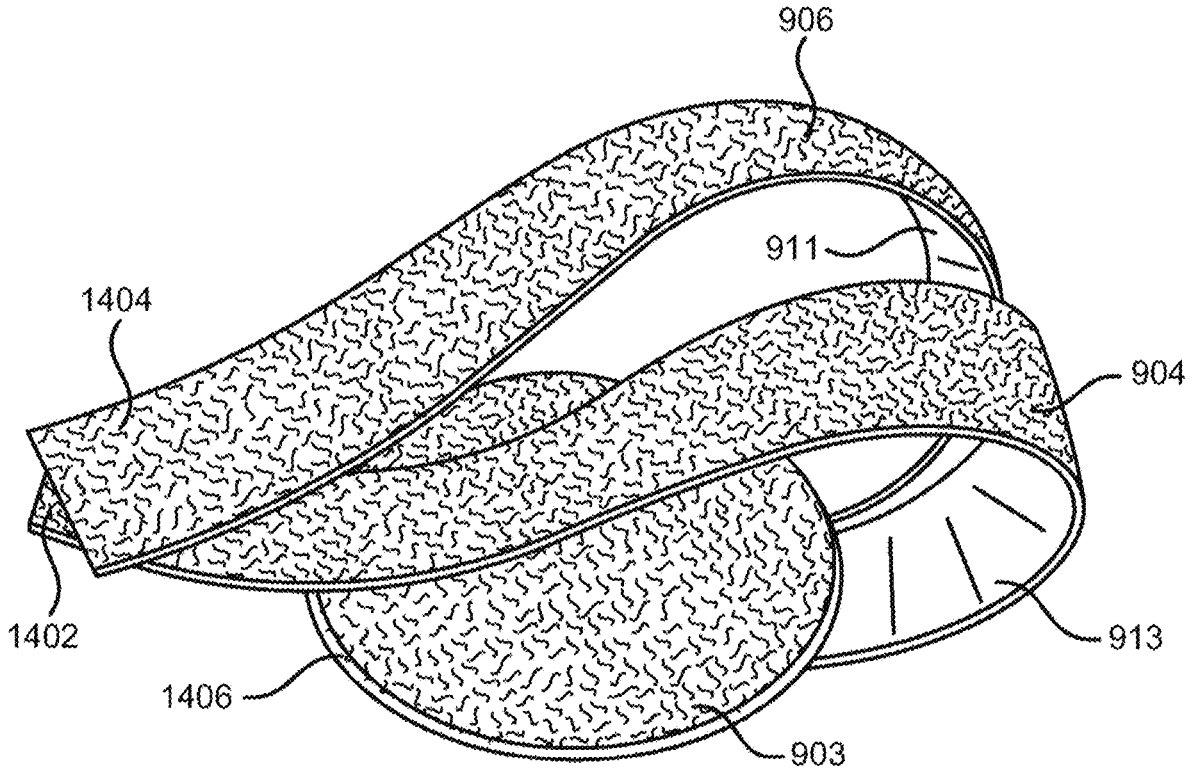
FIG. 33 shows a further affixment arrangement wherein a first affixment arm is affixed to a lower substrate while a second affixment arm is affixed only to the first affixment arm.

FIG. 33 shows a further affixment arrangement wherein first affixment arm 904 is affixed to lower substrate 903 while second affixment arm 906 is affixed only to first affixment arm 904. Thus, first affixment arm 904 and second affixment arm 906 may not only affix to upper surface 902 and lower substrate 903, but also to one another to provide for further affixment arrangement combinations.

Figure 34:
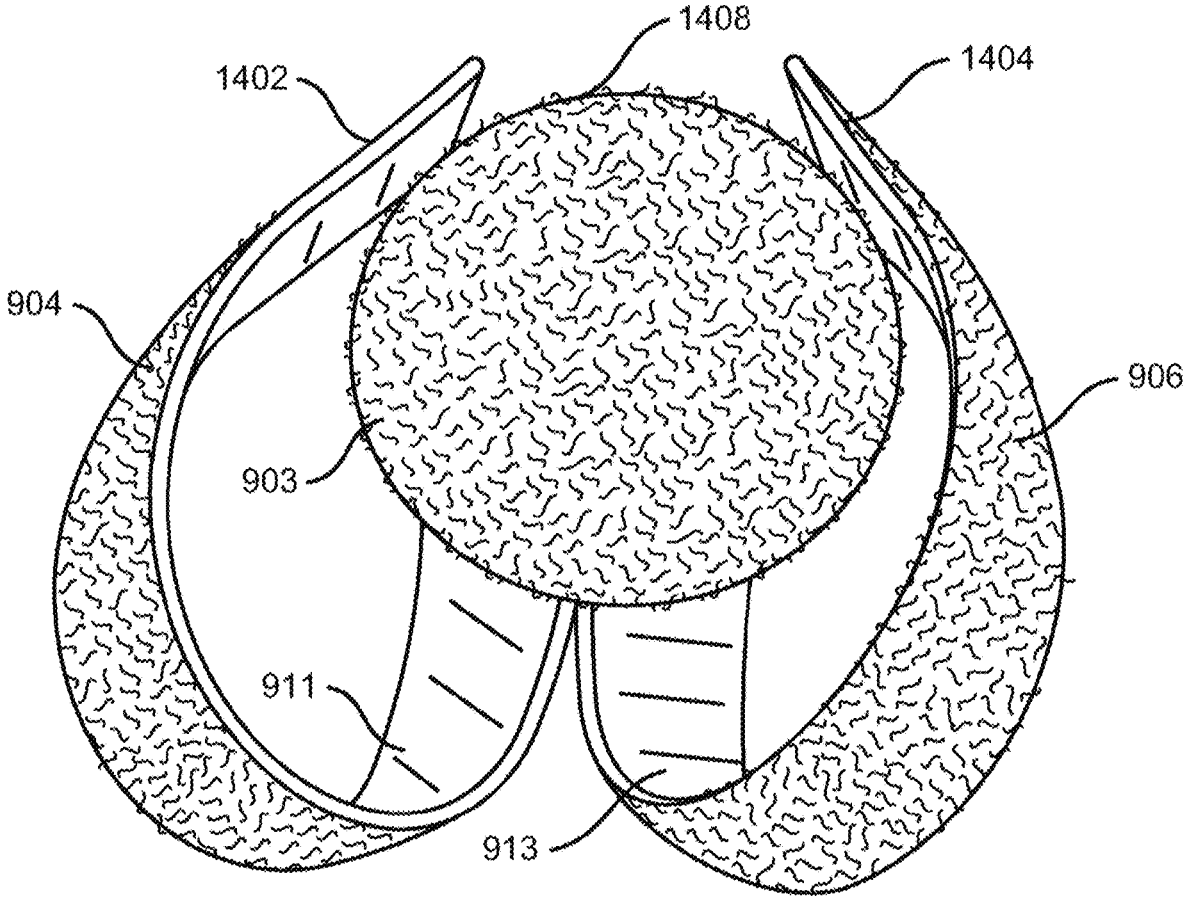
FIG. 34 shows yet another affixment arrangement wherein a first affixment arm and a second affixment arm affix to a perimeter edge of ornamentation affixer substrate.

FIG. 34 shows yet another affixment arrangement wherein first affixment arm 904 and second affixment arm 906 may affix to perimeter edge 1408 of ornamentation affixer substrate 900. Perimeter edge 1408 runs circumferentially around ornamentation affixer substrate 900 upper surface 902 and lower surface 903.

In a further embodiment, the current disclosure provides for ornamentation fixtures, which may affix to ornamentation affixer substrate 900 via engagement with one or more of the upper substrate 902, lower substrate 903, first affixment arm 904, second affixment arm 906 or perimeter edge 1408. At least one surface of the ornamentation fixture is designed to affix, entangle, engage, hook or otherwise affix to any of the surfaces of ornamentation affixer substrate 900. Ornamentation fixture may include designs, shapes, images, etc., for display which are position opposite and facing away from ornamentation affixer substrate 900 upper surface 902 via engagement of at least a portion of underside of the ornamentation fixture or an appendage extending from the ornamentation fixture that contacts a surface of ornamentation affixer substrate 900. All ornamentation has glued on, sewn on or otherwise attached to it the hook portion of a hook-and-loop-system including, but not limited to, Velcro® Brand, 3M® Brand, Duragrip® Brand, and/or other similar hook-and-loop systems whether branded or not. This hook material then attaches to the 'loop' material on surface 903 on substrate 900 as well as attaching to surface 911, the loop portion of affixment arm 904, as well as attaching to the surface of 913, the loop portion of second affixment arm 906. This, then, provides a secure attachment structure to mate the ornamentation to substrate 900 because not only is the ornamentation's hook material mated to the loop material of surface 903, but also the hook material is mated to the loop material on affixment arms 904 and 906. This configuration provides comfort and helps protect a person's skin from abrasion because only the soft loop material is against the skin and the rough, abrasive hook material is lifted well above the straps of the flip flops by several layers of material, specifically, surface 902, surface 903 and affixment arms 904 and 906.

Figure 35B:
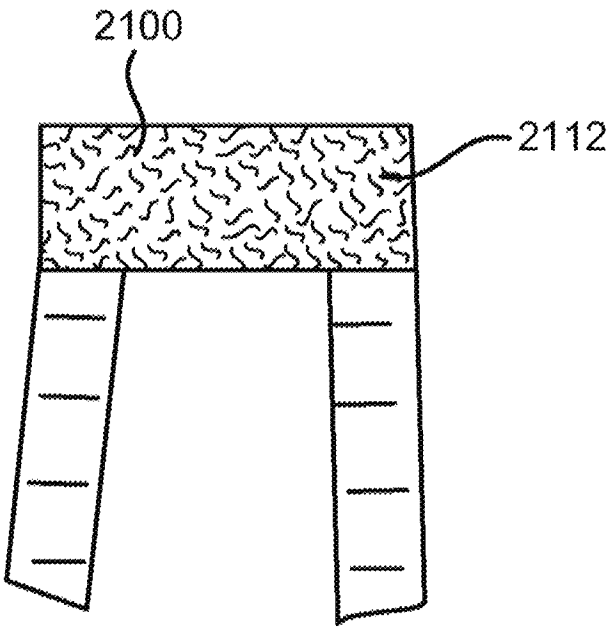
FIG. 35B shows the bottom view of the alternative embodiment of FIG. 35A.
Figure 35A:
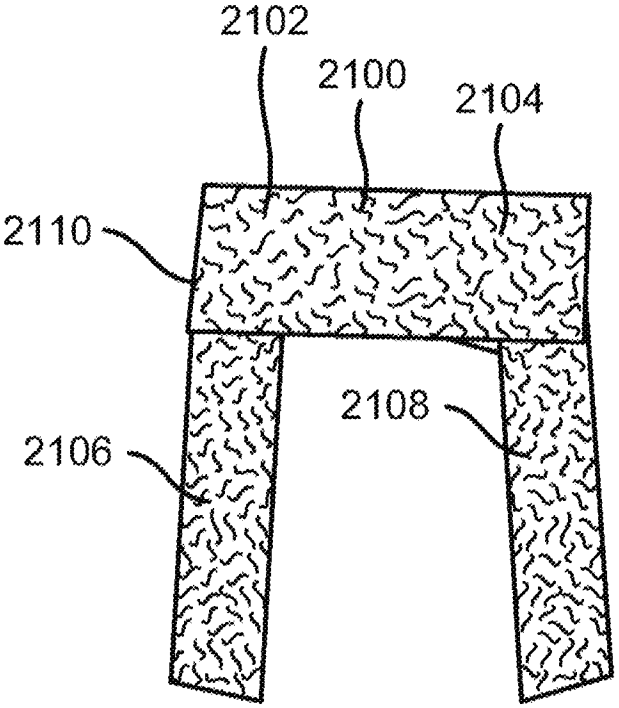
FIG. 35A shows the top view of an alternative embodiment of the current disclosure.
Figure 36:
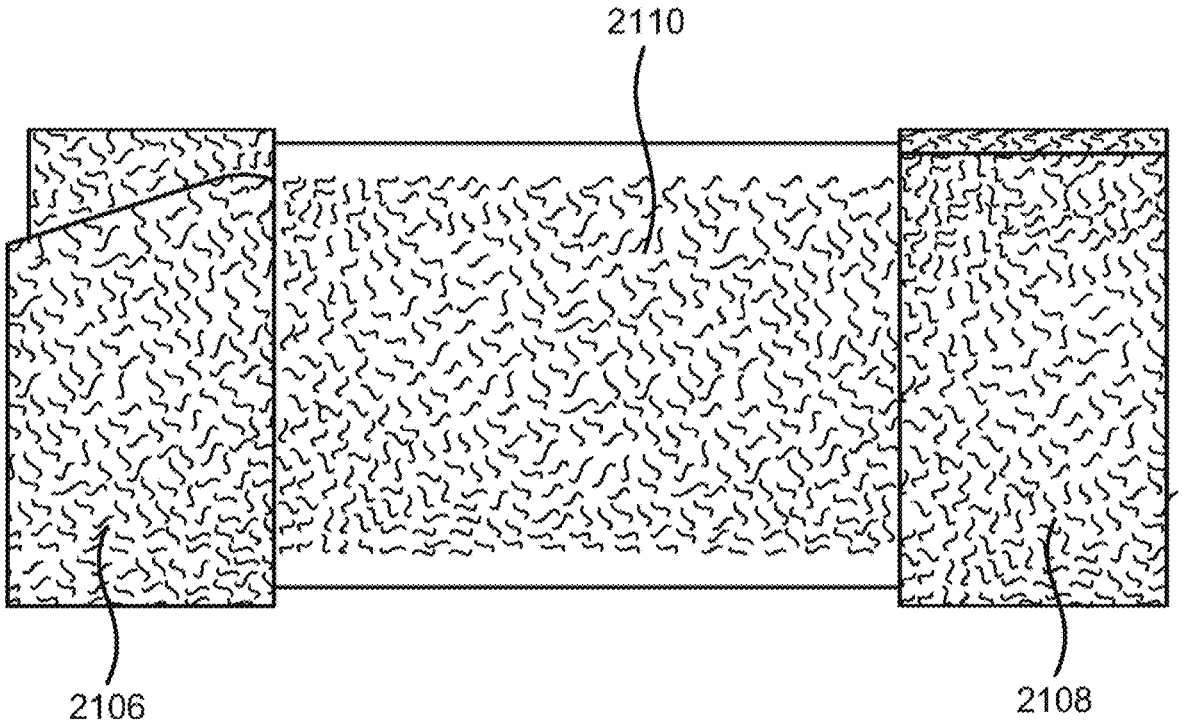
FIG. 36 shows a first arm and second arm engaged to upper rectangular substrate of the alternative embodiment of FIG. 35A.
Figure 37:
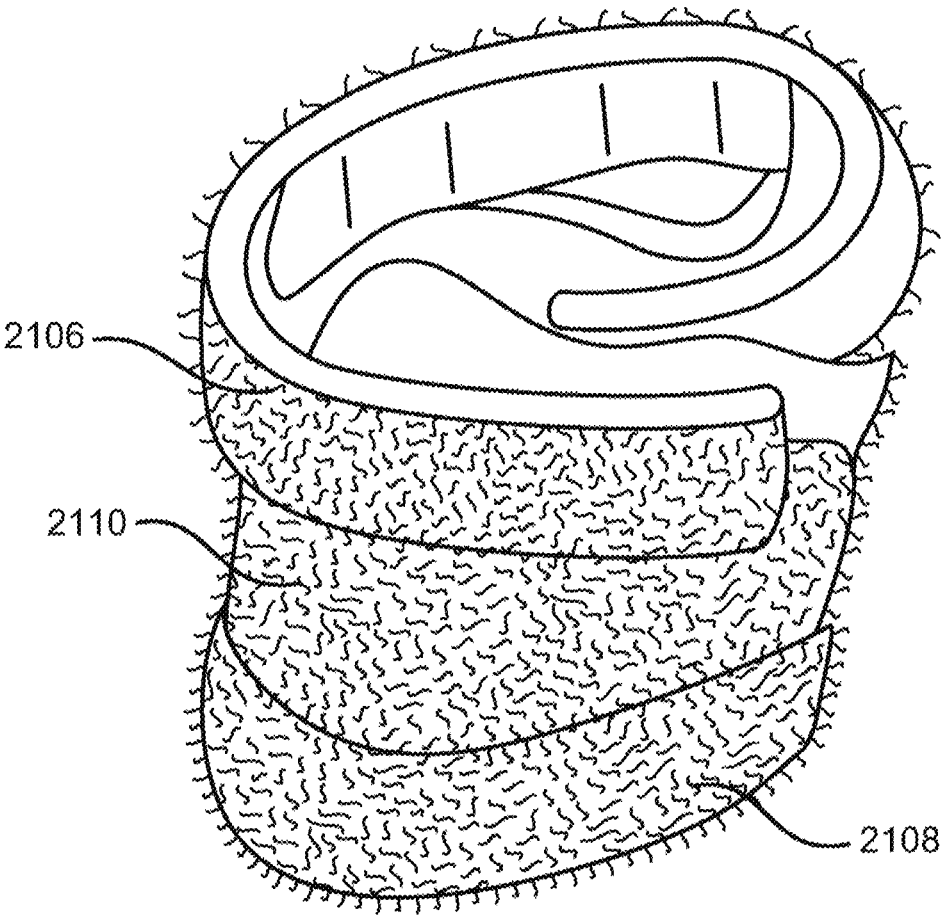
FIG. 37 shows a side view of FIG. 36.
Figures 38A, 38B:
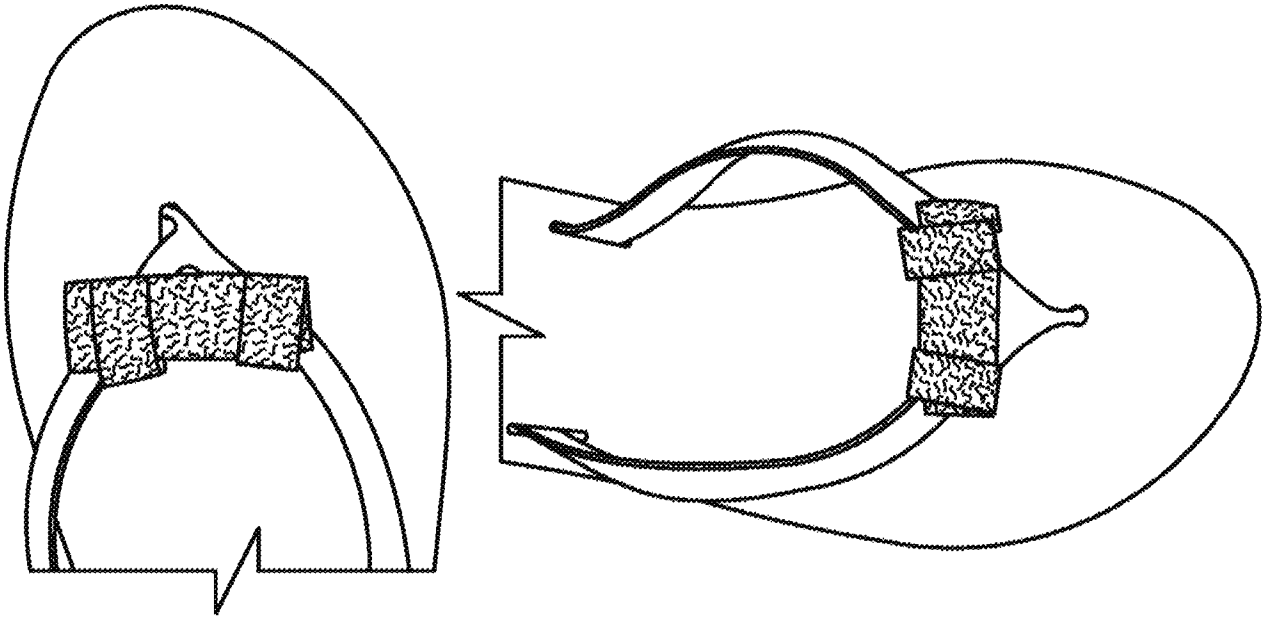
FIGS. 38A, 38B, 38C, 38D, and 38E show the alternative embodiment affixed to footwear viewed in differing orientations of the footwear.
Figure 38E:
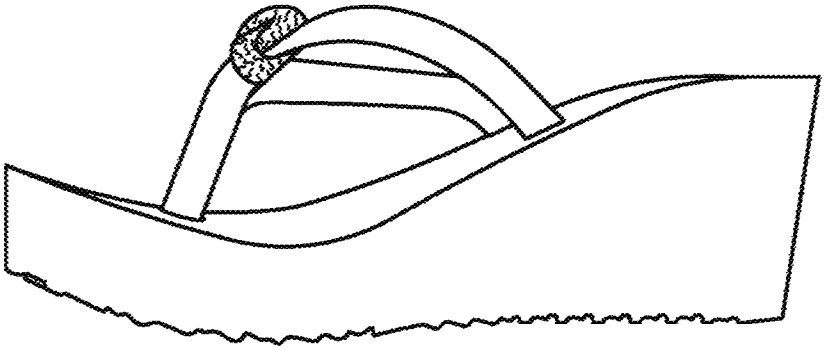
Figure 38D:
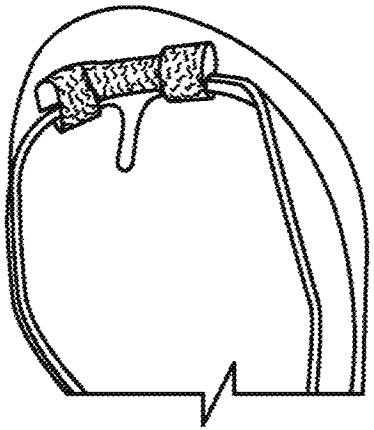
Figure 38C:
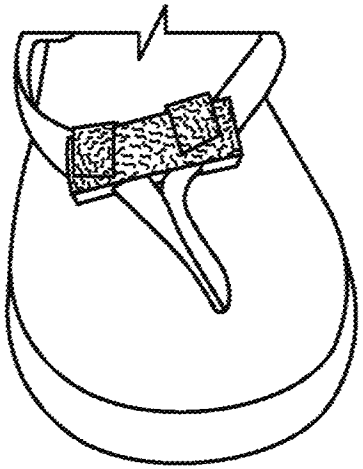
Figure 39:
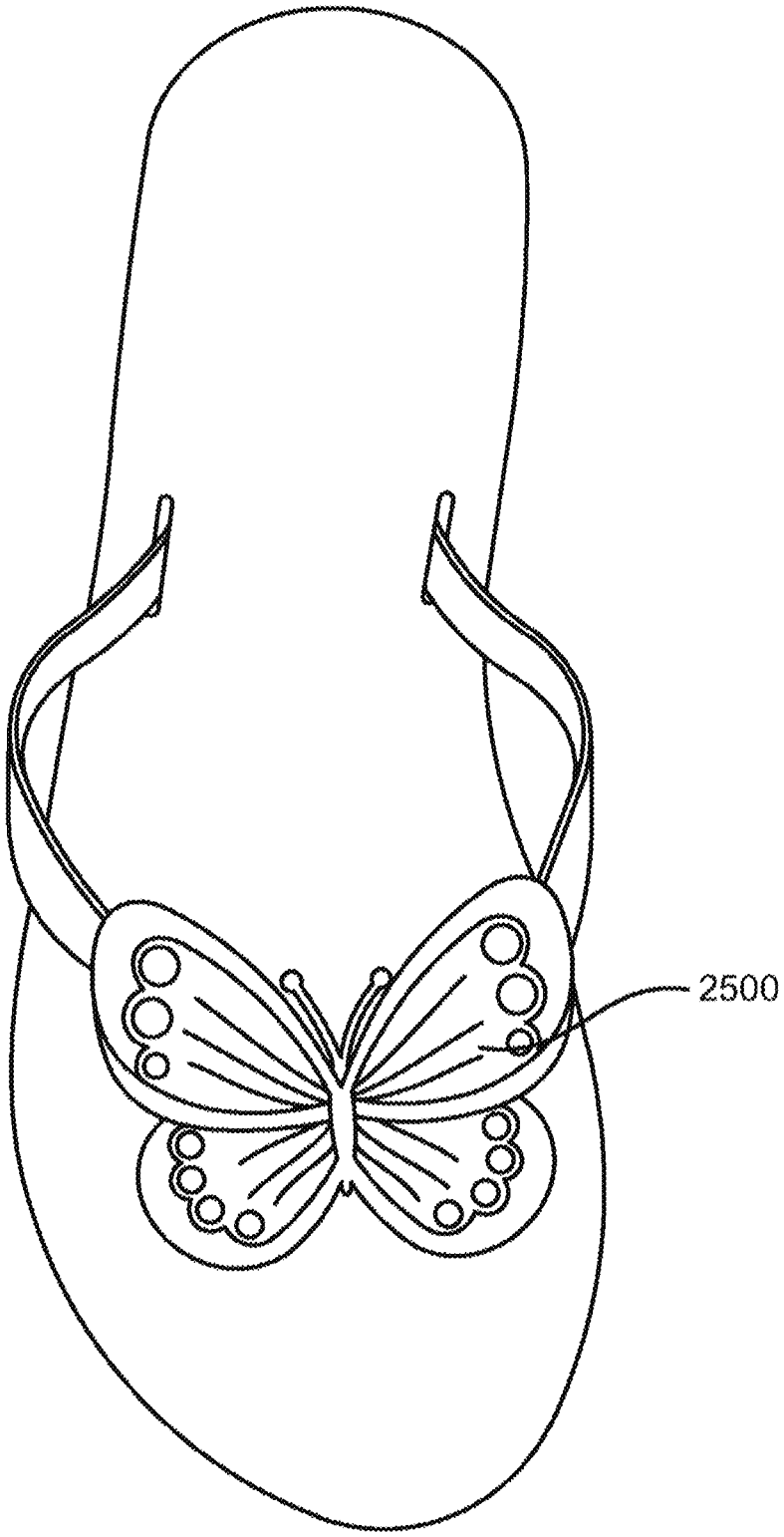
FIG. 39 shows the alternative embodiment hidden underneath the attached Ming.

FIGS. 35A and 35B show an alternative embodiment of an ornamentation affixer substrate 2100 wherein the shape of substrate 2100 may be quadrilateral, parallelogram, trapezoidal, or polygonal in shape. In a preferred embodiment, affixment substrate 2102 may be substantially rectangular in shape. FIG. 35A shows the top view of the alternative embodiment while FIG. 35B shows the bottom view of the alternative embodiment. It has been discovered that a horizontal configuration for upper surface 2104 works very well with narrow bling. Configuring upper surface 2104 as a slim rectangle or other shape, as opposed to round or other shapes that extend past the edges of the bling affixed to footwear, solves the problem of how to attach narrow-bodied bling without seeing the hook & loop attachment of affixer substrate 2100 on the footwear. Further, first arm 2106 and second arm 2108 may be sandwiched between upper rectangular substrate 2110 and lower rectangular substrate 2112 to affix the arms in place. FIG. 36 shows first arm 2106 and second arm 2108 engaged to upper rectangular substrate 2110, demonstrating the narrower fit profile of this embodiment. FIG. 37 shows a side view of FIG. 36. FIGS. 38A, 38B, 38C, 38D, 38E show the alternative embodiment affixed to footwear. FIG. 39 shows the alternative embodiment hidden underneath attached bling 2500.

Figure 40A:
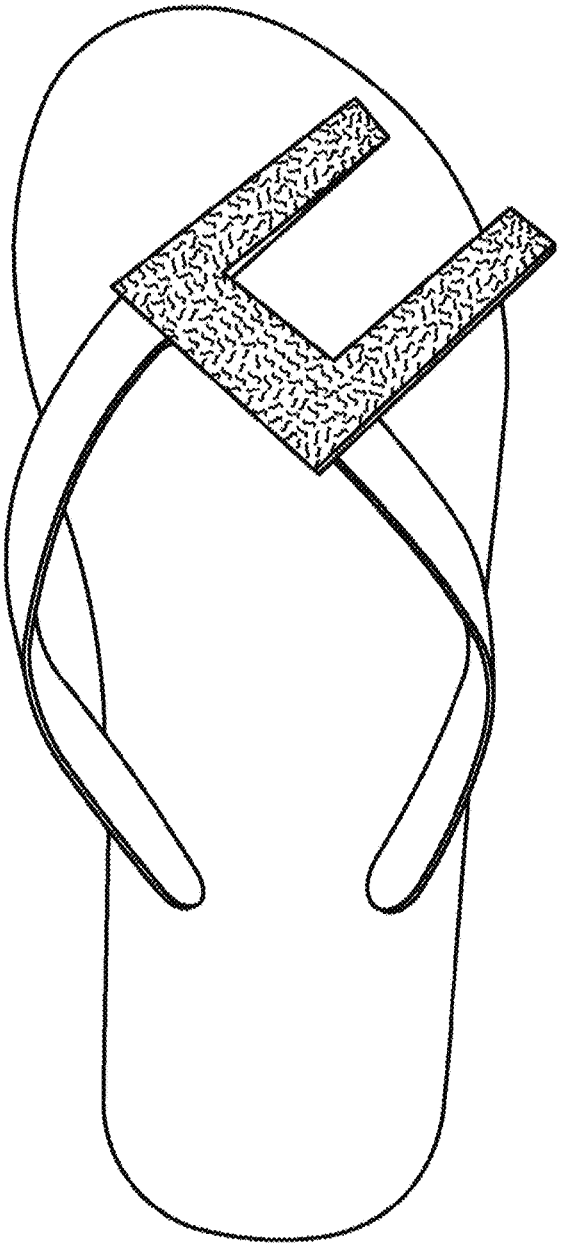
FIG. 40A shows initial placement of one embodiment of the current disclosure on a piece of footwear.
Figure 40B:
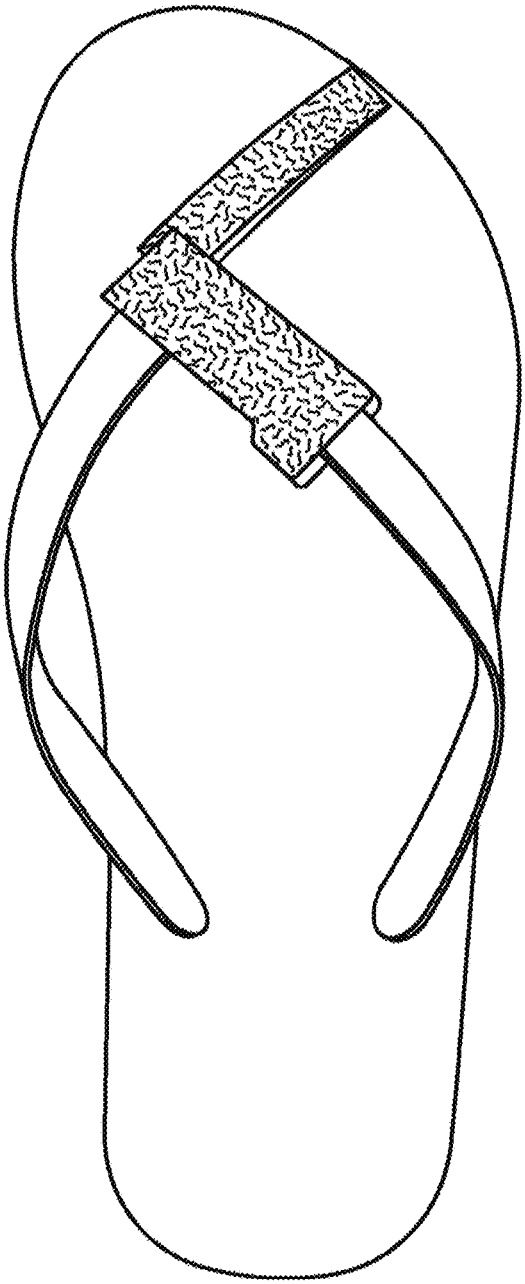
FIG. 40B shows wrapping a first strap of the current disclosure around an attachment area of a piece of footwear.
Figure 40C:
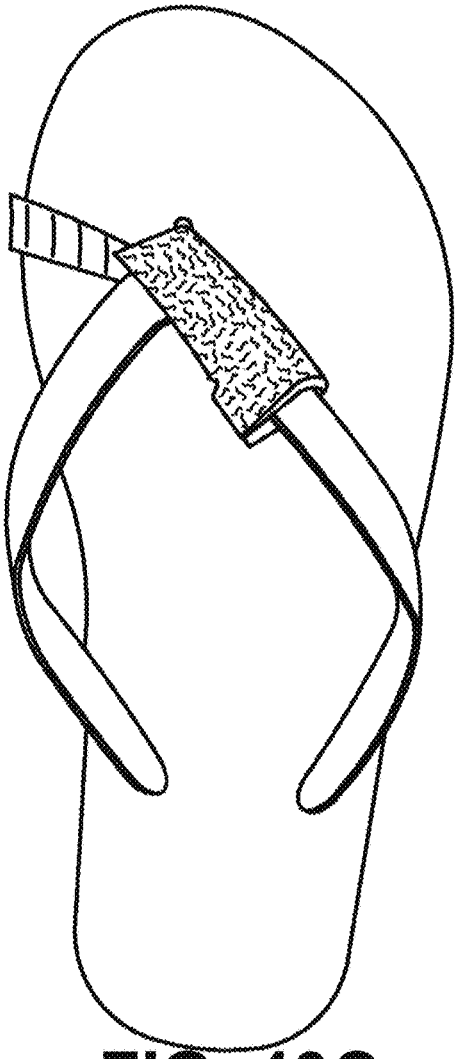
FIG. 40C shows wrapping a second strap of the current disclosure around an attachment area of a piece of footwear.
Figure 40D:
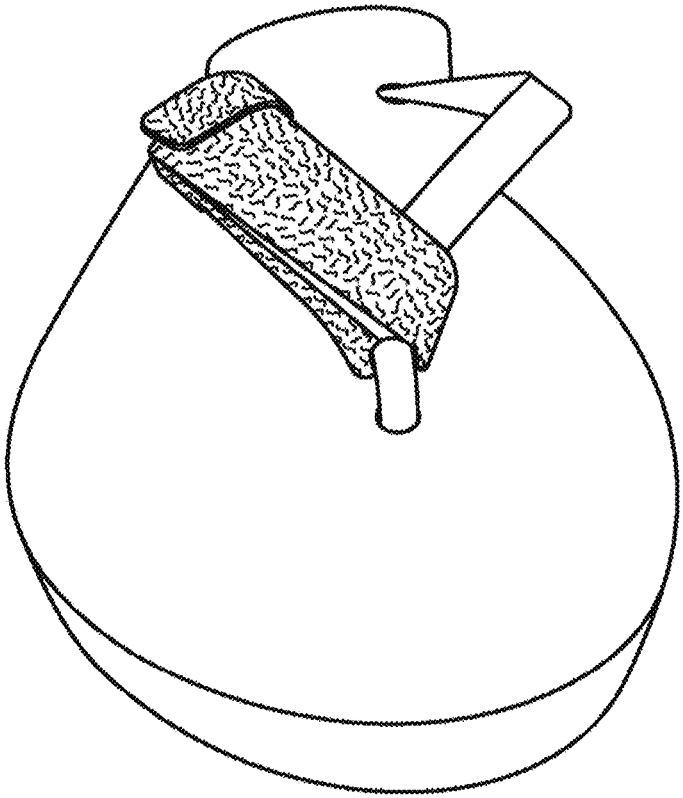
FIG. 40D shows completed installation of the current disclosure on a piece of footwear.
Figure 40E:
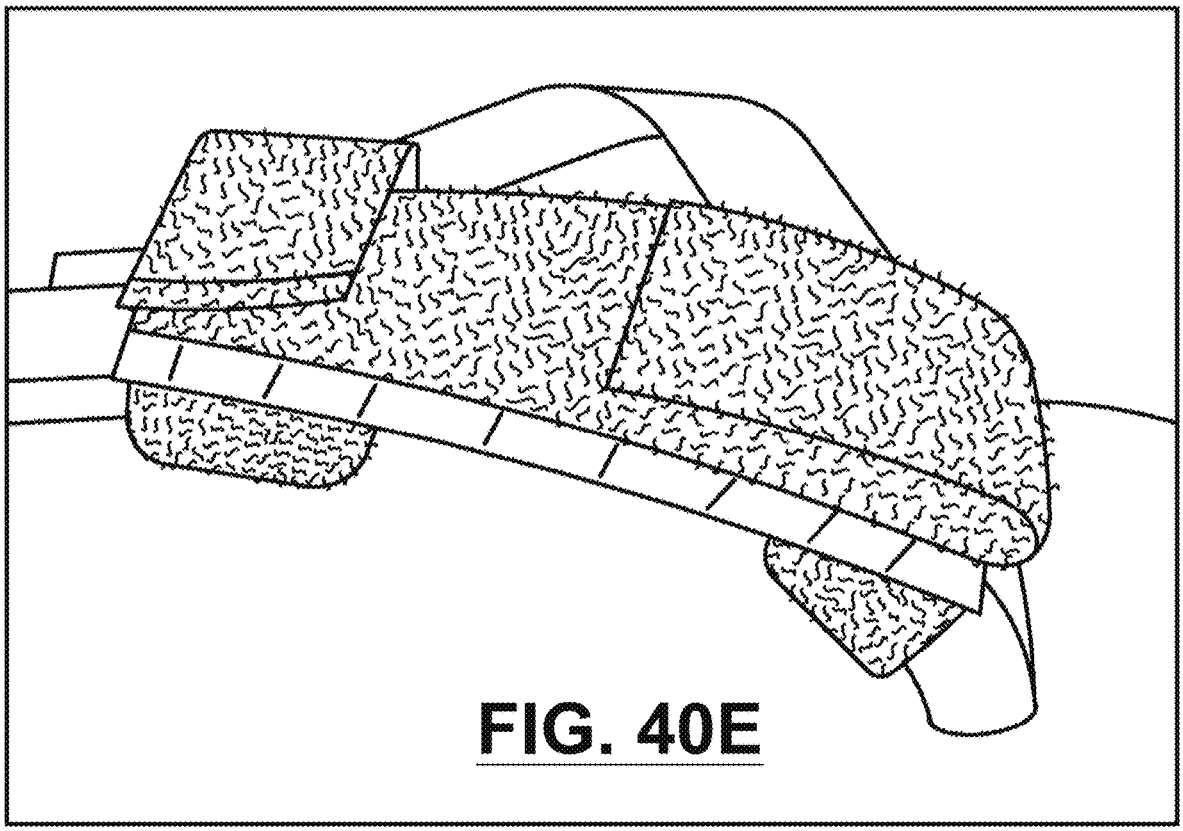
FIG. 40E shows a close-up view of a completed installation of one embodiment of the current disclosure.

The current disclosure may also include instructions on how to use same. Such as beginning with a toe part of flip flop facing away from the user one places a BLING MAKER™ base on top of the thong portion of the flip flop ensuring the ends of the BLING MAKER™ straps point toward the front of the shoe. BLING MAKER™ straps may be configured to be soft on the side facing the wearer's foot and rough on the opposing side to allow for better engagement of "bling". During installation, the soft sides may be positioned "upward" to ensure only the soft side faces the wearer's skin when wrapped around the shoe thong or other area. Once so positioned, the BLING MAKER™ straps may be wrapped tightly around the shoe straps or other footwear engagement features such as laces, etc. For instance, one may wrap the Bling Maker™ straps under the outside strap of flip flop, bring it behind thong part of flip flop, pull it under the inside flip flop strap, and then pull it over the inside strap of flip flop until it affixes to rest of Bling Maker™ base. Once wrapped, excess length of the BLING MAKER™ straps may be cut off with scissors. The extra length provided with the BLING MAKER™ straps allows for installation on a wide variety of shoe types and styles. At this point, the user may connect "bling" ornamentation to the BLING MAKER™ base as the "rough" side of the VELCRO or other affixture means is positioned up, away from the wearer's skin, and ready for attachment of "Ming." FIGS. 40A, 40B, 40C, and 40D illustrate one possible "wrapping" attachment process for the current disclosure. FIG. 40E shows a close-up view of BLING MAKER™ base and straps when wrapped.

Various modifications and variations of the described embodiments, methods, and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An interchangeable ornamentation affixer substrate comprising:

a textured upper surface; wherein the textured upper surface is a surface adhesive which substantially covers the entire upper surface a textured lower surface;

a middle section located between the textured upper surface and textured lower surface;

a textured first affixment arm wherein the textured first affixment arm is a surface adhesive which substantially covers at least one of an upper surface arm and a lower surface arm of the first affixment arm a textured second affixment arm wherein the textured second affixment arm is a surface adhesive which substantially covers at least one of an upper surface arm and a lower surface arm of the second affixment arm wherein the first affixment arm and the second affixment arm are attached at the middle section of the ornamentation affixer substrate;

wherein the first affixment arm and second affixment arm are configured for wrapping around a sandal strap for matingly and removable attachment to the textured upper surface via the surface adhesives such that the first and second affixment arms are attached to the textured upper surface; and wherein the first affixment arm and second affixment arm have a length substantially greater than the length of the textured upper surface and a width substantially less than the width of the textured upper surface to accommodate attachment to sandal straps of multiple sizes and to accommodate attachment of a first removable ornamentation to the textured upper surface via the surface adhesive of the textured upper surface.

2. The interchangeable ornamentation affixer substrate of claim 1, wherein the textured upper surface and the textured lower surface comprise different surface adhesives.

3. The interchangeable ornamentation affixer substrate of claim 1, wherein the first removable ornamentation is removed and replaced with a second removable ornamentation.

4. The interchangeable ornamentation affixer substrate of claim 1, wherein the interchangeable ornamentation affixer substrate is affixed to footwear.

5. The interchangeable ornamentation affixer substrate of claim 1, wherein the textured first affixment arm and second affixment arm are pliable with respect to the middle section.

6. The interchangeable ornamentation affixer substrate of claim 1, wherein the textured first affixment arm and second affixment arm are configured to removably attach and detach from one another.

7. The interchangeable ornamentation affixer substrate of claim 1, wherein the upper arm surface and lower arm surface of the textured first affixment arm and second affixment arm comprise different surface adhesives from one another with the upper arm surface comprising a loop attachment structure as well as the textured upper surface comprising the same loop attachment structure.

* * * * *